US012279673B2

(12) United States Patent
Luedecke

(10) Patent No.: US 12,279,673 B2
(45) **Date of Patent: *Apr. 22, 2025**

(54) ARTICLE WITH RIBBON STRUCTURE HAVING NODES AND LINKS

(71) Applicant: Under Armour, Inc., Baltimore, MD (US)

(72) Inventor: Tom Luedecke, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/581,227

(22) Filed: Feb. 19, 2024

(65) Prior Publication Data

US 2024/0188683 A1 Jun. 13, 2024

Related U.S. Application Data

(63) Continuation of application No. 17/583,806, filed on Jan. 25, 2022, now Pat. No. 11,910,872, which is a (Continued)

(51) Int. Cl.
*A43B 23/02* (2006.01)
*D05C 17/00* (2006.01)

(52) U.S. Cl.
CPC ..... *A43B 23/025* (2013.01); *A43B 23/0205* (2013.01); *A43B 23/0215* (2013.01);

(Continued)

(58) Field of Classification Search
CPC ..... A43B 23/025; A43B 1/14; A43B 7/06; A43B 23/0215; A43B 23/0265; A43B 23/02; A43B 7/085

(Continued)

(56) References Cited

U.S. PATENT DOCUMENTS 313,301 A 3/1885 Cross
888,476 A 5/1908 Davis (Continued)

FOREIGN PATENT DOCUMENTS

CN 2712122 Y 7/2005
CN 201431021 3/2010

(Continued)

OTHER PUBLICATIONS

Paiho Sparta III Website, available at: http://www.paiho.com/index.php/en/menu-en-lefl-np-sparta (Nov. 3, 2015).

(Continued)

*Primary Examiner* — Marie D Bays
(74) *Attorney, Agent, or Firm* — Maginot, Moore & Beck, LLP

(57) ABSTRACT

An article of footwear with an upper including a ribbon structure is disclosed. The ribbon structure comprises ribbon sections running in at least two different directions. Ribbon sections are connected at nodes. Between nodes portions of ribbon act like links joining the nodes. The links can be arranged in various geometries, including a rectangular grid and a triaxial grid. The ribbon structure may extend the entire length of the article of footwear, and may extend through a forefoot, midfoot and heel.

20 Claims, 21 Drawing Sheets

Related U.S. Application Data continuation of application No. 16/871,845, filed on May 11, 2020, now Pat. No. 11,241,064, which is a continuation of application No. 16/026,757, filed on Jul. 3, 2018, now Pat. No. 10,716,362.

(52) U.S. Cl.
CPC ..... *A43B 23/0245* (2013.01); *A43B 23/027* (2013.01); *A43B 23/0275* (2013.01); *D05C 17/00* (2013.01)

(58) Field of Classification Search
USPC ..... 36/9 R, 45, 47
See application file for complete search history.

(56) References Cited

U.S. PATENT DOCUMENTS

| | | | |
|---|---|---|---|
| 1,124,184 | A | 1/1915 | Straub |
| 1,217,463 | A | 2/1917 | Krieger |
| 1,314,239 | A | 8/1919 | Bancroft |
| 1,469,222 | A | 10/1923 | La Chapelle |
| 2,118,255 | A | 5/1938 | Loucks et al. |
| 2,413,824 | A | 1/1947 | Glassman |
| 3,497,971 | A | 3/1970 | Hayashi |
| 3,570,151 | A | 3/1971 | Eaton |
| 3,704,474 | A | 12/1972 | Winkler |
| 4,027,406 | A | 6/1977 | Salvatore |
| 4,254,563 | A | 3/1981 | Bruno |
| 4,393,605 | A | 7/1983 | Spreng |
| 5,673,639 | A | 10/1997 | Miyachi et al. |
| 6,060,145 | A | 5/2000 | Smith et al. |
| 6,267,068 | B1 | 7/2001 | Fickers et al. |
| 7,032,328 | B2 | 4/2006 | Wilson et al. |
| 7,089,691 | B1 | 8/2006 | Silvera |
| 7,115,315 | B2 | 10/2006 | Fowler |
| 7,293,371 | B2 | 11/2007 | Aveni |
| 8,122,616 | B2 | 2/2012 | Meschter et al. |
| 8,595,878 | B2 | 12/2013 | Huffa et al. |
| 8,656,606 | B2 | 2/2014 | Hooper |
| 8,819,963 | B2 | 9/2014 | Dojan et al. |
| 9,179,739 | B2 | 11/2015 | Bell et al. |
| 9,420,844 | B2 | 8/2016 | Meir et al. |
| 9,622,542 | B2 | 4/2017 | Greene |
| 9,655,407 | B2 | 5/2017 | Reinhardt et al. |
| 10,716,362 | B2 | 7/2020 | Luedecke |
| 10,736,380 | B2 | 8/2020 | Luedecke et al. |
| 11,241,064 | B2 | 2/2022 | Luedecke |
| 11,330,866 | B2 | 5/2022 | Luedecke |
| 11,910,872 | B2 * | 2/2024 | Luedecke ..... D05C 17/00 |
| 2002/0178610 | A1 | 12/2002 | Cheng |
| 2003/0089000 | A1 | 5/2003 | Tseng |
| 2003/0148076 | A1 | 8/2003 | Huang |
| 2004/0118018 | A1 | 6/2004 | Dua |
| 2005/0153614 | A1 | 7/2005 | Dohler |
| 2005/0241181 | A1 | 11/2005 | Cheng |
| 2005/0262734 | A1 | 12/2005 | Cheng |
| 2005/0262735 | A1 | 12/2005 | Cheng |
| 2005/0284002 | A1 | 12/2005 | Aveni |
| 2006/0048413 | A1 | 3/2006 | Sokolowski et al. |
| 2006/0059715 | A1 | 3/2006 | Aveni |
| 2007/0271822 | A1 | 11/2007 | Meschter |
| 2007/0271823 | A1 | 11/2007 | Meschter |
| 2009/0071041 | A1 | 3/2009 | Hooper |
| 2009/0133287 | A1 | 5/2009 | Meschter |
| 2010/0107442 | A1 | 5/2010 | Hope et al. |
| 2011/0041359 | A1 | 2/2011 | Dojan et al. |
| 2011/0107620 | A1 | 5/2011 | Bell et al. |
| 2011/0237995 | A1 | 9/2011 | Ota et al. |
| 2011/0287212 | A1 | 11/2011 | Miloslavsky |
| 2012/0017468 | A1 | 1/2012 | Dojan et al. |
| 2012/0023778 | A1 | 2/2012 | Dojan et al. |
| 2012/0324658 | A1 | 2/2012 | Dojan et al. |
| 2012/0198727 | A1 | 8/2012 | Long |
| 2012/0297642 | A1 | 11/2012 | Schaefer et al. |
| 2013/0019500 | A1 | 1/2013 | Greene |
| 2013/0081307 | A1 | 4/2013 | del Biondi et al. |
| 2013/0139329 | A1 | 6/2013 | Ferniani et al. |
| 2013/0247417 | A1 | 9/2013 | Nurse et al. |
| 2013/0255103 | A1 | 10/2013 | Dua et al. |
| 2013/0312284 | A1 | 11/2013 | Berend et al. |
| 2014/0020193 | A1 | 1/2014 | Dojan et al. |
| 2014/0059883 | A1 | 3/2014 | Adeagbo et al. |
| 2014/0101969 | A1 | 4/2014 | Pham |
| 2014/0109441 | A1 | 4/2014 | McDowell et al. |
| 2014/0130270 | A1 | 5/2014 | Baudouin et al. |
| 2014/0157623 | A1 | 6/2014 | Dekovic |
| 2014/0173934 | A1 | 6/2014 | Bell |
| 2014/0237858 | A1 | 8/2014 | Adami et al. |
| 2014/0238082 | A1 | 8/2014 | Meir |
| 2014/0283411 | A1 | 9/2014 | Nabernik et al. |
| 2014/0310986 | A1 | 10/2014 | Tamm et al. |
| 2014/0338222 | A1 | 11/2014 | Song |
| 2014/0373389 | A1 | 12/2014 | Bruce |
| 2015/0201701 | A1 | 7/2015 | Shapiro |
| 2015/0210034 | A1 | 7/2015 | Tarrier et al. |
| 2015/0272272 | A1 | 10/2015 | Berns et al. |
| 2015/0272274 | A1 | 10/2015 | Berns |
| 2016/0213095 | A1 | 7/2016 | Kohatsu et al. |
| 2016/0286898 | A1 | 10/2016 | Manz et al. |
| 2016/0316855 | A1 | 11/2016 | Berns |
| 2016/0316856 | A1 | 11/2016 | Berns |
| 2016/0345674 | A1 | 12/2016 | Bruce et al. |
| 2016/0345675 | A1 | 12/2016 | Bruce et al. |
| 2016/0345677 | A1 | 12/2016 | Bruce et al. |
| 2016/0345678 | A1 | 12/2016 | Mokos |
| 2016/0353828 | A1 | 12/2016 | Chen |
| 2017/0035149 | A1 | 2/2017 | Bruce et al. |
| 2017/0143076 | A1 | 5/2017 | Farris |
| 2017/0156434 | A1 | 6/2017 | Tamm et al. |
| 2017/0156439 | A1 | 6/2017 | Yoshida et al. |
| 2017/0156445 | A1 | 6/2017 | Guest et al. |
| 2017/0157846 | A1 | 6/2017 | Miller et al. |
| 2017/0332722 | A1 | 11/2017 | Dealey et al. |
| 2017/0340064 | A1 | 11/2017 | Salomon |
| 2018/0116317 | A1 | 5/2018 | Inoue et al. |
| 2019/0166950 | A1 | 6/2019 | Sinclair |

FOREIGN PATENT DOCUMENTS

| | | | |
|---|---|---|---|
| CN | 103989290 | | 8/2014 |
| FR | 2626201 | A1 | 7/1989 |
| GB | 1079731 | A | 8/1967 |
| JP | 06057613 | A | 3/1994 |
| JP | 08246323 | A | 9/1996 |
| JP | 2016195676 | A | 11/2016 |
| TW | 340310 | | 9/1998 |
| TW | 351073 | | 1/1999 |
| TW | 351670 | | 2/1999 |
| TW | 353601 | | 3/1999 |
| TW | 412939 | | 11/2000 |
| TW | 503275 | B | 9/2002 |
| TW | 521584 | | 2/2003 |
| TW | M257116 | U | 2/2005 |
| TW | M357218 | U | 5/2009 |
| TW | M378896 | U | 4/2010 |
| TW | M420202 | U | 1/2012 |
| TW | M433118 | | 7/2012 |
| TW | M437635 | | 9/2012 |
| TW | M451012 | U | 4/2013 |
| TW | M456105 | | 7/2013 |
| TW | M433121 | U | 4/2014 |
| TW | M476496 | | 4/2014 |
| TW | M527445 | | 8/2016 |
| TW | M476494 | U | 11/2016 |
| WO | 90/03744 | A1 | 4/1990 |
| WO | 2015038243 | A1 | 3/2015 |

OTHER PUBLICATIONS

International Search Report and Written Opinion mailed Sep. 20, 2018 in PCT/US2018/039904.

(56) References Cited

OTHER PUBLICATIONS

International Search Report and Written Opinion issued May 1, 2019 for Application No. PCT/US2019019481.
International Search Report and Written Opinion issued May 1, 2019 for Application No. PCT/US2019/019490.
International Search Report and Written Opinion issued May 7, 2019 for Application No. PCT/US2019/019492.
International Search Report and Written Opinion issued May 13, 2019 for Application No. PCT/US2019/019486.
Wikipedia, "Stich (textile arts)" May 6, 2016 (May 6, 2016), retrieved on Apr. 24, 2019 from https://enwikipedia.org/w/index php?title=Stitch_(textile_arts )&oldid= 718918887.
International Search Report and Written Opinion issued Sep. 11, 2019 for Application No. PCT/US2019/038388.
International Search Report and Written Opinion issued Sep. 17, 2019 for Application No. PCT/US2019/038392.
International Preliminary Report on Patentability mailed Jan. 14, 2021 for PCT Application No. PCT/US2019/019490.

* cited by examiner

ARTICLE WITH RIBBON STRUCTURE HAVING NODES AND LINKS

CROSS REFERENCE TO RELATED APPLICATIONS

The present application is a continuation of U.S. Nonprovisional application Ser. No. 17/583,806, filed Jan. 25, 2022 and entitled "Article With Ribbon Structure Having Nodes and Links," which is a continuation of U.S. Nonprovisional application Ser. No. 16/871,845, filed 11 May 2020 and also entitled "Article with Ribbon Structure Having Nodes and Links," which is a continuation of U.S. Nonprovisional application Ser. No. 16/026,757, filed 3 Jul. 2018 and also entitled "Article with Ribbon Structure Having Nodes and Links." The disclosure of each application is hereby incorporated by reference in its entirety.

BACKGROUND

Embroidery is a traditional method of decorating, tailoring, mending, patching, or reinforcing textile materials by sewing with a needle and stitching material. Hand-embroidered goods date back as late as the Warring States period in China. During the industrial revolution, the invention of the sewing machine and dedicated embroidery machines expanded the use of the technique. Modern embroidery techniques may utilize machine-readable code to autonomously create an embroidery pattern on a sheet of textile materials. Textile materials include fabrics such as cotton, wool, or silk, as well as leather, foam, polymer sheets, and synthetic equivalents. On the textile materials, a number of stitch techniques (such as the chain stitch, the buttonhole or blanket stitch, the running stitch, the satin stitch, or the cross stitch) may be used depending on the purpose of the embroidery. The stitching techniques may be used in combination to form a variety of set patterns. The stitching patterns may be decorative; for example, the pattern may form a flower or series of flowers. Alternatively, the stitching may be structural, such as stitching along the edges of a garment to reinforce the seams. In further cases, the stitching may be both decorative and functional, such as the use of a floral pattern used to reinforce a patch.

Typically, a thread or yarn is used as the stitching material and stitched into the textile. Commonly, the thread or yarn may be made of cotton or rayon, as well as traditional materials like wool, linen, or silk. However, embroidery may also sew in dissimilar materials to the textile, usually for decorative purposes. For example, thread created out of precious metals such as gold or silver may be embroidered within more traditional fabrics such as silk. Additional elements (such as beads, quills, sequins, pearls, or entire strips of metal) may be sewn in during embroidery. These elements may be sewn in along with yarn or thread using a variety of stitching techniques, depending on the desired placements of the elements.

SUMMARY

In one aspect, an article of footwear includes an upper having a first direction and a second direction, where the second direction is different than the first direction. The ribbon structure includes a first set of ribbon sections oriented substantially in the first direction and a second set of ribbon sections oriented substantially in the second direction. At least one ribbon section in the first set of ribbon sections is stitched to at least one ribbon section in the second set of ribbon sections. The first set of ribbons is placed in tension in response to a force applied along the first direction. The second set of ribbon sections remains substantially slack along the second direction while the force is applied along the first direction.

In another aspect, an article of footwear includes an upper including a ribbon structure. The ribbon structure comprises a pattern of ribbon portions and nodes. The ribbon structure includes a first node and a second node, the first node and the second node being connected by a ribbon portion. The first node can move substantially relative to the second node.

In another aspect, an article of footwear includes an upper with a ribbon structure. The ribbon structure comprises a pattern of ribbon portions and nodes. The ribbon structure includes a first node and a second node. An orientation of the second node can be changed substantially without changing the orientation of the first node.

In another aspect, an article of footwear includes an upper including a ribbon structure, the ribbon structure including a first ribbon portion and a second ribbon portion arranged in a two-dimensional pattern and meeting at a node. A stitch penetrates the first ribbon portion and the second ribbon portion at the node.

In another aspect, an article of footwear includes an upper with a ribbon structure. The ribbon structure includes a first ribbon portion and a second ribbon portion, the first ribbon portion and the second ribbon portion meeting at a node. The first ribbon portion has a pre-stretched length. The first ribbon portion undergoes inelastic deformation when the first ribbon portion is stretched by more than 40 percent of the pre-stretched length.

In another aspect, an upper for an article of footwear includes a ribbon structure with a first ribbon portion, a second ribbon portion, and a third ribbon portion. The first ribbon portion is coupled to the second ribbon portion at a first node. The second ribbon portion is coupled to the third ribbon portion at a second node. The third ribbon portion is coupled to the first ribbon portion at a third node.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, with emphasis instead being placed upon illustrating the principles of the embodiments. Moreover, in the figures, like reference numerals designate corresponding parts throughout the different views.

DETAILED DESCRIPTION

Figure 1:
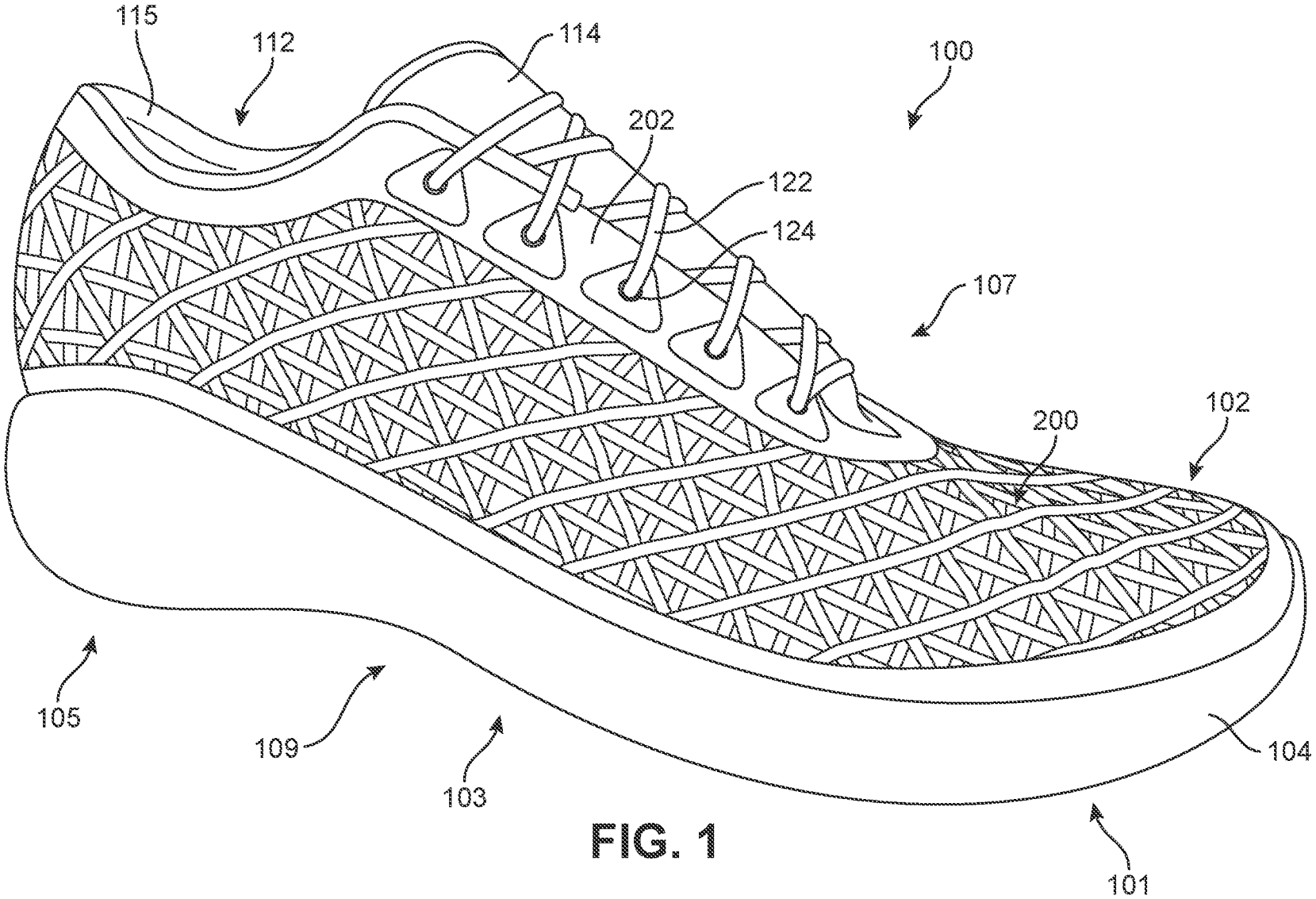
FIG. 1 is a schematic view of an embodiment of an article of footwear.

The embodiments are related to an article including one or more ribbon sections. As used herein, the term "article" refers broadly to articles of footwear, articles of apparel (e.g., clothing), as well as accessories and/or equipment. For the purposes of general reference, an article is any item designed to be worn by or on a user, or act as an accessory. In some embodiments, an article may be an article of footwear, such as a shoe, sandal, boot, etc. In other embodiments, an article may be an article of apparel, such as a garment, including shirts, pants, jackets, socks, undergarments, or any other conventional item. In still other embodiments, an article may be an accessory such as a hat, glove, or bag worn by the wearer.

Articles of footwear include, but are not limited to, hiking boots, soccer shoes, football shoes, sneakers, running shoes, cross-training shoes, rugby shoes, basketball shoes, baseball shoes as well as other kinds of shoes. Moreover, in some embodiments, components may be configured for various kinds of non-sports-related footwear, including, but not limited to, slippers, sandals, high-heeled footwear, loafers as well as any other kinds of footwear. Articles of apparel include, but are not limited to, socks, pants, shorts, shirts, sweaters, undergarments, hats, gloves, as well as other kinds of garments. Accessories include scarves, bags, purses, backpacks, as well as other accessories. Equipment may include various kinds of sporting equipment including, but not limited to, bats, balls, various sporting gloves (e.g., baseball mitts, football gloves, ski gloves, etc.), golf clubs, as well as other kinds of sporting equipment.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal," as used throughout this detailed description and in the claims, refers to a direction extending along the length of a component. For example, a longitudinal direction of an article of footwear extends from forefoot region 101 to heel region 105 of article of footwear 100. The term "forward" or "front" is used to refer to the general direction in which the toes of a foot point, and the term "rearward" or "back" is used to refer to the opposite direction, i.e., the direction in which the heel of the foot is facing.

The term "lateral direction," as used throughout this detailed description and in the claims, refers to a side-to-side direction extending along the width of a component. In other words, the lateral direction may extend between medial side 107 and lateral side 109 of article of footwear 100, with lateral side 109 of article of footwear 100 being the surface that faces away from the other foot, and medial side 107 being the surface that faces toward the other foot.

The term "vertical," as used throughout this detailed description and in the claims, refers to a direction generally perpendicular to both the lateral and longitudinal directions. For example, in cases where an article of footwear is planted flat on a ground surface, the vertical direction may extend from the ground surface upward. It will be understood that each of these directional adjectives may be applied to individual components of an article of footwear. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

For purposes of general reference, as illustrated in FIG. 1, article of footwear 100 may be divided into three regions: forefoot region 101, midfoot region 103, and heel region 105. Forefoot region 101 may be generally associated with the toes and joints connecting the metatarsals with the phalanges. Midfoot region 103 may be generally associated with the arch of a foot, including the instep. Likewise, heel region 105 or "hindfoot" may be generally associated with the heel of a foot, including the calcaneus bone. For purposes of this disclosure, the following directional terms, when used in reference to an article of footwear, shall refer to the article of footwear when sitting in an upright position, with the sole facing the ground, that is, as it would be positioned when worn by a wearer standing on a substantially level surface.

It will be understood that the forefoot region, the midfoot region, and the heel region are only intended for purposes of description and are not intended to demarcate precise regions of an article of footwear. For example, in some cases, one or more of the regions may overlap. Likewise, the medial side and the lateral side are intended to represent generally two sides, rather than precisely demarcating an article of footwear into two halves. In addition, the forefoot region, the midfoot region, and the heel region, as well as the medial side and the lateral side, may also be applied to individual components of an article of footwear, including a sole structure, an upper, a lacing system, and/or any other component associated with the article.

Article of footwear 100 may include upper 102 and a sole or "sole structure" 104, which define an internal cavity between the upper and sole. The "interior" of an article of footwear refers to space in this internal cavity that is occupied by a wearer's foot when the article of footwear is worn. The "inner side" or "inside" of an element refers to the face of that element that is (or will be) oriented toward the internal cavity in a completed article of footwear. The "outer side," "outside," or "exterior" of an element refers to the face of that element that is (or will be) oriented away from the internal cavity in the completed article of footwear 100. In some cases, the inner side of an element may have other elements between that inner side and the interior in the completed article of footwear 100. Similarly, an outer side of an element may have other elements between that outer side and the space external to the completed article of footwear 100. Further, the terms "inward" and "inwardly" shall refer to the direction toward the interior of the article of footwear, and the terms "outward" and "outwardly" shall refer to the direction toward the exterior of article of footwear 100.

Upper 102 provides a covering for the wearer's foot that comfortably receives and securely positions the foot with respect to the sole structure. In general, upper 102 includes opening 112 that provides entry for the foot into an interior cavity of upper 102 in heel region 105. Upper 102 may also include tongue 114 that provides cushioning and support across the instep of the foot. An upper may be of a variety of styles depending on factors such as desired use and required ankle mobility. For example, an athletic shoe with an upper having a "low-top" configuration extending below the ankle that is shaped to provide high mobility for an ankle. An upper could be configured as a "high-top" upper extending above the wearer's ankle for basketball or other activities, or as a "mid-top" configuration extending to about the wearer's ankle. Furthermore, an upper may also include non-athletic shoes, such as dress shoes, loafers, sandals, and work boots.

Upper 102 may also include other known features in the art including heel tabs, loops, etc. Furthermore, upper 102 may include a toe cage or box in the forefront region. Even further, upper 102 may include logos, trademarks, and instructions for care.

Upper 102 may include a fastener on a fastening region of the upper. For example, the fastening provision may be lacing system 122, or "lace," applied at a fastening region of upper 102. Other kinds of fastening provisions include, but are not limited to, laces, cables, straps, buttons, zippers as well as any other provisions known in the art for fastening articles. For a lacing system, the fastening region comprises plurality of eyelets 124 that may be disposed within an eye stay element. The fastening region may comprise one or more tabs, loops, hooks, D-rings, hollows, or any other provisions known in the art for fastening regions.

Sole structure 104 is positioned between a foot of a wearer and the ground, and may incorporate various component elements. For example, sole structure 104 may include one or more of inner sole component or "insoles," a middle sole element or "midsole," and an outer sole element or "outsole." An insole may take the form of a sockliner adjacent the wearer's foot to provide a comfortable contact surface for the wearer's foot. It will be understood that an insole may be optional. Further, a midsole may directly serve as a cushion and support for the foot. In addition, an outsole may be configured to contact the ground surface.

Upper 102 and sole structure 104 may be coupled using any conventional or suitable manner, such as adhesion or bonding, via a woven connection, via one or more types of fasteners, etc. In some cases, a sole structure and upper may be combined together in a single unitary construction.

Sole structure 104 may contact a ground surface and have various features to deal with the ground surface. Examples of ground surfaces include, but are not limited to, indoor ground surfaces such as wood and concrete floors, pavement, natural turf, synthetic turf, dirt, as well as other surfaces. In some cases, the lower portions of sole structure 104 may include provisions for traction, including, but not limited to, traction elements, studs, and/or cleats.

Sole structure 104 may be made of a variety of any suitable material or pluralities of materials for a variety of functions. For example, one or more components of sole structure 104, such as the midsole, may be formed from a polymer foam (e.g., a polyurethane or ethylvinylacetate foam) material that attenuates ground reaction forces (i.e., provides cushioning) during walking, running, and other ambulatory activities. In addition, the components of a sole may also include gels, fluid-filled chambers, plates, moderators, inserts, or other elements that further attenuate forces, enhance stability, or influence the motions of the foot. In addition, the other components may have specific surface properties, such as an outsole being made from a durable material, such as carbon or blown rubber, which is further textured to impart traction. Furthermore, the insole may be made from a waterproof material such as a synthetic such as ethylvinylacetate to prevent moisture seeping into the sole.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" shall refer to the joining of two components in a manner such that the two components are secured together, but may be readily detached from one another. Examples of removable attachment mechanisms may include hook and loop fasteners, friction fit connections, interference fit connections, threaded connectors, cam-locking connectors, and other such readily detachable connectors. Similarly, "removably disposed" shall refer to the assembly of two components in a non-permanent fashion.

The term "strand" includes a single fiber, filament, or monofilament, as well as an ordered assemblage of textile fibers having a high ratio of length to diameter and normally used as a unit (e.g., slivers, roving, single yarns, plies yarns, cords, braids, ropes, etc.). The term "thread" as used herein may refer to a strand used for stitching.

The embodiments discuss methods of embroidering or sewing one or more elements to a substrate. Embroidering an element to a substrate comprises stitching the element in place with a thread, yarn, or other strand of material.

The present application is directed to an upper including ribbon and portions or sections of ribbon. As used herein, the term "ribbon" refers to a long, narrow strip of material. In addition to the provisions described herein and shown in the figures, the embodiments may make use of any of the structures, components, and/or methods for making articles with ribbon as disclosed in Luedecke et al., U.S. Application Publication Number 2019/0017205, currently application Ser. No. 15/648,638, filed Jul. 13, 2017 and titled "Article with Embroidered Tape Sections," the entirety of which is herein incorporated by reference and referred to as "The Tape Sections Application."

Figure 2:
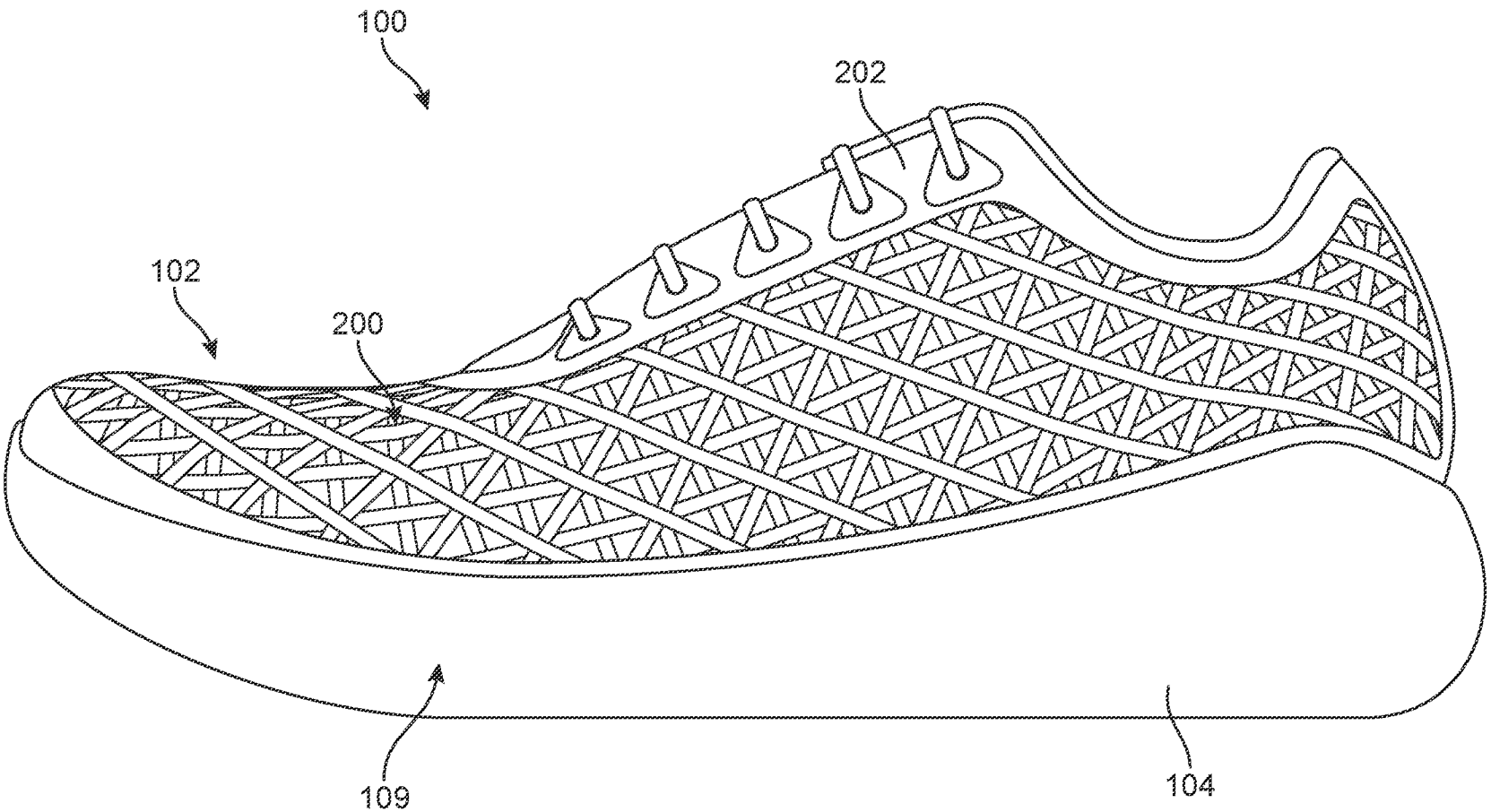
FIG. 2 is a schematic side view of an embodiment of an article of footwear.

FIG. 2 is a schematic side view of an embodiment of article of footwear 100. Referring to FIGS. 1-2, upper 102 may be comprised of ribbon structure 200 and border element 202. The term "ribbon structure," as used throughout this detailed description and in the claims, refers to any structure that is formed by attaching or otherwise arranging one or more ribbon pieces, sections, or portions into a structure on an upper.

A ribbon structure may extend through at least a portion of an upper. In the embodiment of FIG. 2, ribbon structure 200 extends through the entirety of upper 102. Specifically, ribbon structure 200 extends through forefoot region 101, midfoot region 103, and heel region 105 as well as through both medial side 107 and lateral side 109. In other words, in some cases, ribbon structure 200 extends through a majority of the area of upper 102. In some cases, ribbon structure 200 extends through at least 50% of the area of upper 102. In other cases, ribbon structure 200 extends through 50-90% of the area of upper 102. In the embodiment of FIGS. 1-2, ribbon structure 200 extends through at least 95% of the area of upper 102.

Border element 202 may extend only on various edges or boundaries of upper 102. Border element 202 may extend along edges of upper 102 that are attached to sole structure 104 as well as along the periphery of opening 112.

Upper 102 may include an inner lining. Upper 102 could be configured with a bootie that is stitched or otherwise attached to an interior of upper 102. Upper 102 may not include an inner lining or bootie and instead ribbon structure 200 could be a freestanding structure. In the embodiment shown in FIGS. 1-2, upper 102 includes inner mesh layer 115.

A ribbon structure can be comprised of one or more ribbon sections. In some cases, ribbon sections could be separate segments or pieces (i.e., detached at their ends from one another). In other cases, ribbon sections or could be part of a continuous ribbon with no natural boundary between adjacent sections.

Figure 27:
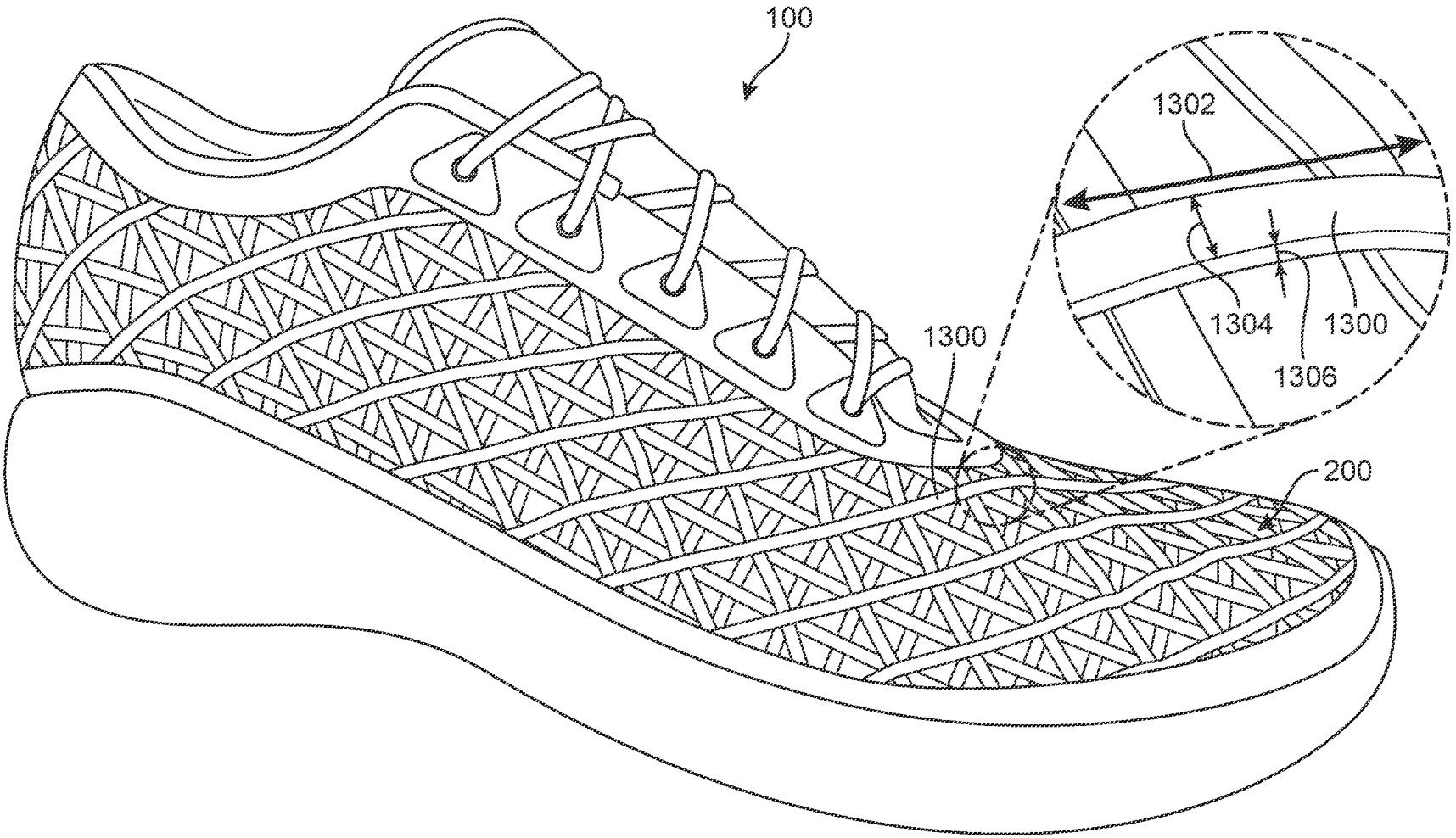
FIG. 27 is a schematic view of an embodiment of an article with an enlarged view of a region of a ribbon structure.

A ribbon may generally have a width that is greater than its thickness, giving the ribbon a two-dimensional appearance in contrast to threads or other strands that have a one-dimensional appearance. The dimensions of one or more ribbons could vary. For example, the thickness of a ribbon could vary in a range between approximately 0.2 millimeters and 1 millimeters. As another example, the width of a ribbon could vary in a range between approximately 2 millimeters and approximately 6 millimeters (e.g., 3 millimeters). If the width is substantially less than 2 millimeters the ribbon may be more difficult to stitch, weld, or otherwise attach to a backing layer or other element (e.g., another ribbon). If the width is substantially greater than 6 millimeters, the ribbon may tend to bend or fold with respect to a lengthwise direction, which may make attachment more difficult. The length of the section of ribbon may vary according to the particular pattern or design for an article and may generally be 10 millimeters or more. For purposes of clarity, FIG. 27 illustrates an exemplary embodiment of a ribbon 1300 with various dimensions. Ribbon 1300 has a lengthwise direction 1302. Ribbon 1300 may intersect one or more other ribbons as it extends along lengthwise direction 1302. Ribbon 1300 also includes a width 1304 and a thickness 1306. In the embodiment of FIG. 27 width 1304 may be approximately 3 millimeters and thickness 1306 may be approximately 0.5 millimeters.

The material of one or more ribbons may vary. The material could be any material including a thermoplastic. Examples of thermoplastics include, but are not limited to: thermoplastic polyurethane (TPU), acrylic, nylon, polylactic acid (PLA), polyethylene, or acrylonitrile butadiene styrene (ABS) or ethylene vinyl acetate (EVA). Ribbons could comprise a fabric material. Alternatively, ribbons may be made from a foam, a film, and/or a composite with multiple layers—including polymer layers and fabric layers, for example.

A ribbon may be made of a material that undergoes little to no stretch under tension. This may help ensure the ribbon provides strength and support to parts of a foot along a tensioned direction. In some cases, the ribbon could stretch less than 40% of its pre-stretched length before inelastically deforming or before individual fibers begin to break. In some cases, the ribbon could stretch less than 20% of its pre-stretched length before inelastically deforming or before individual fibers begin to break. In one case, the ribbon could stretch less than 10% of its pre-stretched length before inelastically deforming or before individual fibers begin to break. That is, in one case, the ribbon could undergo elastic deformation of up to 10% of its pre-stretched length and return to its pre-stretched length without permanent change to its structure. To accommodate the stretch of a ribbon, the thread used to embroider or otherwise stitch the ribbon in place may be selected to have a degree of stretch that matches the degree of stretch of the ribbon, or which is greater than the degree of stretch of the ribbon.

Ribbons can have a knit, braided or woven construction. Ribbons could be made of a woven material that resists stretching. Moreover, the woven material may comprise a 0 and 90 degree weave arranged as a single layer.

Ribbons could be made of materials that expand under heat and/or pressure. Exemplary expanding materials include foam materials, expanding polymers, expanding films, and/or other expandable materials.

Border element 202 may comprise a continuous element that extends around the entire periphery of border element 202. Alternatively, border element 202 may be discontinuous and may have gaps along the periphery.

A border element may comprise threads stitched to another layer (e.g., a ribbon layer and/or a substrate/backing layer). A border element may comprise a standalone structure of threads that have been stitched together to form an interlocking matrix. The embroidered regions and/or structures of the present disclosure may utilize any of the structures, patterns, or features disclosed in Berns et al., U.S. Publication Number 2015/0272272, published on Oct. 1, 2015, filed on Mar. 25, 2015 as U.S. application Ser. No. 14/668,935, and titled "Footwear Including Textile Element," the entirety of which is herein incorporated by referenced and referred to as the "Embroidered Structures Application."

As discussed in the Embroidered Structures Application, some embodiments may incorporate self-supporting embroidered structures with threads or yarns arranged in a matrix that lacks a backing or support layer. Such embroidered structures could be formed by first stitching threads to a backing layer and later removing the backing layer. The embodiments can use any of the methods for forming embroidered structures as disclosed in the Embroidered Structures Application.

Threads used for embroidery or other forms of stitching may be comprised from a variety of materials. For example, thread may be made of polymer materials including nylon, polyethylene, TPU, PVA, or EVA as well as Dyneema fiber made from Ultra-High Molecular Weight Polyethylene. Thread may also include a blend of polymer materials and may include nitrile rubber. Thread also may be made from more conventional materials including cotton, silk, or other natural fibers disclosed herein. Other materials that may be used include, but are not limited to, nylon, polyester, polyacrylic, polypropylene, polyethylene, metal, silk, cellulosic fibers, elastomers, etc. Thread also may be made from any known synthetic equivalent. In some cases, exposing the thread to heat or pressure may cause the thread to melt or fuse. In other cases, exposing the thread to heat or pressure may cause the thread to dissolve. In still other cases, the thread may dissolve when exposed to a solvent, such as acid or water.

Threads may be comprised of a material that stretches lengthwise under tension. For example, in some embodiments, a thread could be an elastic thread. As an example, an elastic thread comprised of 60-70% polyester and 30-40% polyurethane could be used.

A first kind of thread may be used to embroider or otherwise stitch ribbons in place on a backing layer or other substrate. In addition, one or more border elements may be formed by further stitching over the ribbons and/or substrate layers using a second kind of thread. In some cases, the first and second kinds of thread could be similar kinds of threads. In other cases, however, the first and second kinds of thread could be different kinds of threads. For example, in some cases, the first kind of thread used to embroider down ribbons may have a narrower diameter than the second kind of thread used to form one or more border elements. Additionally, in some cases, the first and second kinds of thread could have different colors with the first kind of thread having a color that matches the color of ribbons and the second kind of thread having a color that is different (but perhaps complimentary to) than the color of the ribbons.

A backing layer, or backer layer, may be used during the embroidery process. A backing layer, in general, provides a layer to which one or more elements may be stitched. A backing layer may remain after manufacturing to provide, for example, an inner lining for an article. Alternatively, the backing layer may be melted into the article. A backing layer could also be separated from other elements of an article after embroidering one or more ribbon sections into place. For example, the backing layer could be dissolved. Some embodiments can include an optional backing layer for a ribbon structure that may be distinct from an inner lining of an upper.

The materials of backing layers may vary. Backing layers or sheets may be used as an anti-abrasion layer, and may be made of a material soft to the skin, such as silk or cotton, as well as synthetic-like equivalents such as nylon, or foam materials. Backing layers may be used to prevent an article from stretching during embroidery, and may be used from a harder more rigid substance, such as a sheet made from TPU, PVA, or EVA. Backing layers may also be made from a fusible material such as EV, or a dissolvable material such as TPU, PVA, or EVA. Furthermore, backing layers may combine various materials for different purposes for different sections. For example, a rigid dissolvable backing material may be used in combination with a soft permanent backing layer. The backing layer may include a mesh. More specifically, the mesh may be elastic. It may be appreciated that any of the materials described here for backing layers could be used for ribbons.

Figure 3:
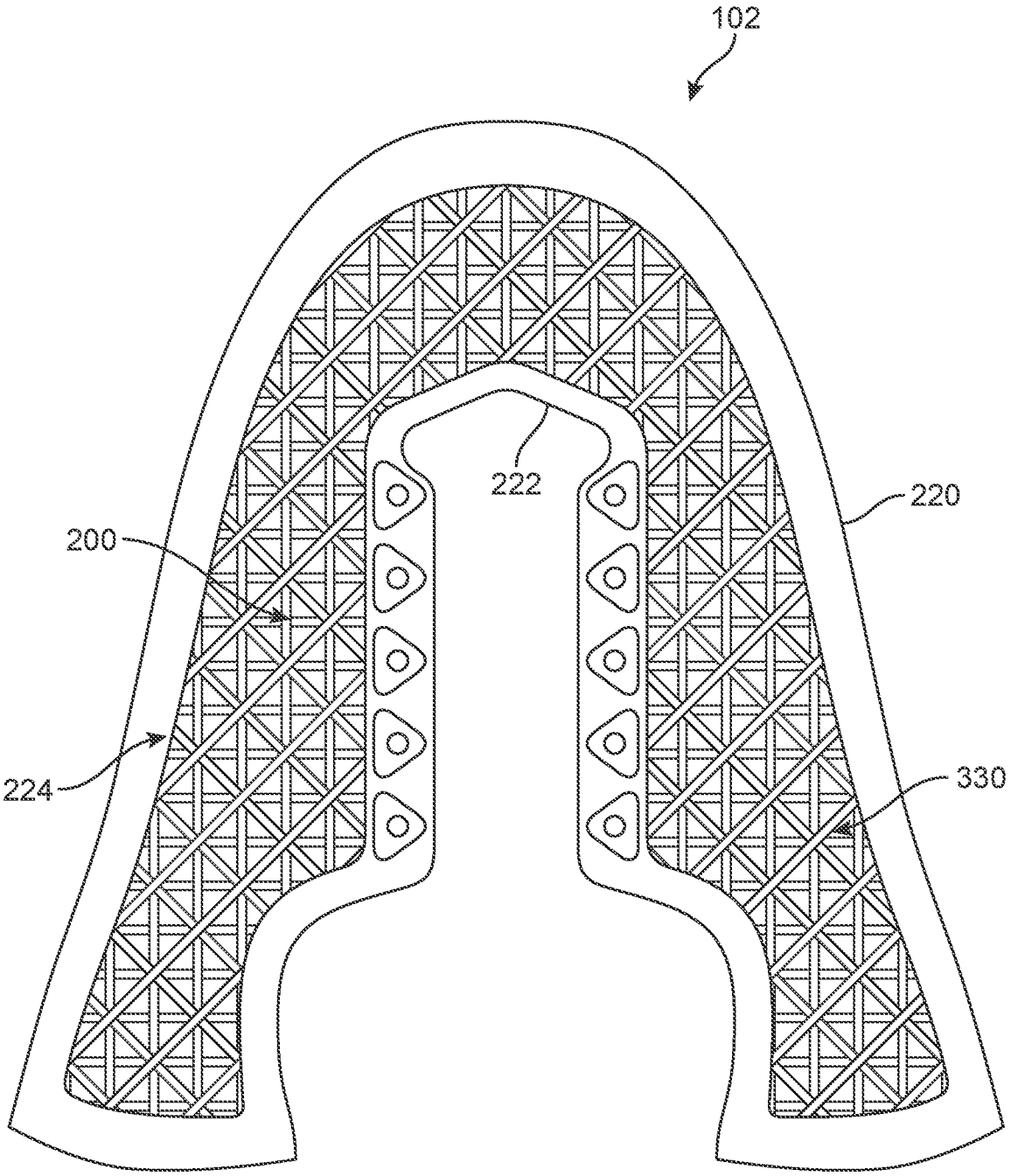
FIG. 3 is a top-down schematic view of an embodiment of an upper with a ribbon structure.

FIG. 3 is a schematic top-down view of upper 102 in a flattened configuration (i.e., in a configuration immediately following manufacturing of the upper but before the upper has been shaped and joined with sole structure 104).

Referring first to FIG. 3, upper 102 has outer peripheral edge 220 and inner peripheral edge 222. Inner peripheral edge 222 may extend around a lacing region of upper 102 as well as around other parts of a throat opening of upper 102. Outer peripheral edge 220 may be disposed adjacent a sole structure (e.g., sole structure 104 in FIGS. 1-2) when upper 102 is assembled with the sole structure. Upper 102 also includes outer side 224 and an inner side (not shown). The inner side is the side of upper 102 that faces an interior foot receiving cavity of upper 102 while outer side 224 faces away from the interior foot receiving cavity.

With respect to these edges and sides, ribbon structure 200 extends substantially continuously throughout an interior region bounded by outer peripheral edge 220 and inner peripheral edge 222. One or more continuous ribbons of ribbon structure 200 wind back and forth between inner peripheral edge 222 and outer peripheral edge 220. In other cases, separate ribbon sections may be laid out in a parallel manner within each layer. In the exemplary embodiment of FIG. 3, the entirety of ribbon structure 200 is comprised of a single continuous ribbon.

Figure 28:
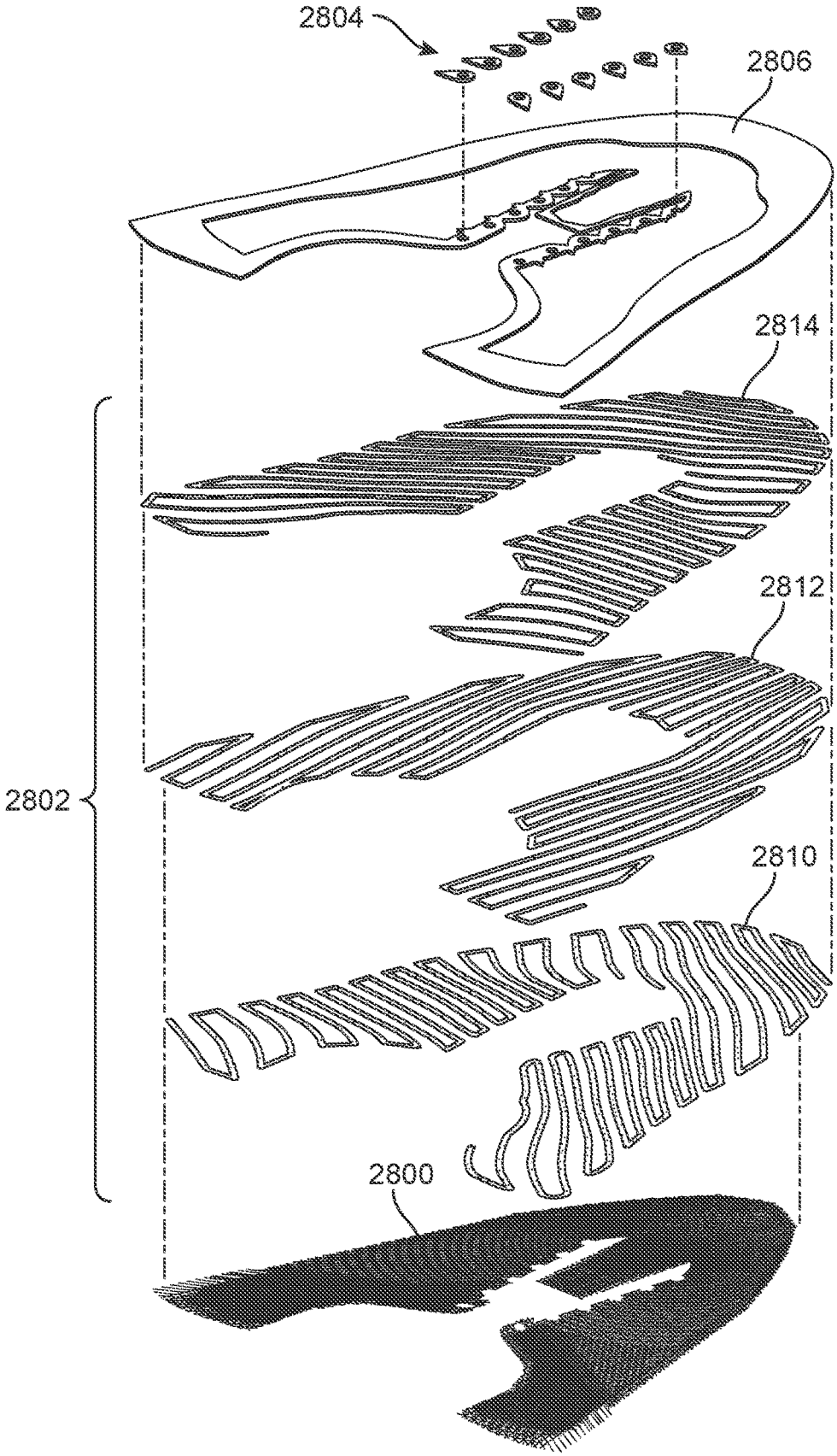
FIG. 28 is an exploded isometric view of various ribbon layers comprising the upper of FIG. 3.

For example, FIG. 28 illustrates an example embodiment of a ribbon structure forming various ribbon layers using a continuous ribbon for upper 102 shown in FIG. 3. In this embodiment, the upper includes an (optional) self-supporting embroidered layer 2802, ribbon structure 2802, a peripheral layer 2806, and a plurality of eyelets 2804. Ribbon structure 2802 comprises a plurality of parallel layers formed by winding a continuous ribbon back and forth to form each layer. In this embodiment, ribbon structure 2802 includes a first layer 2810, a second layer 2812, and a third layer 2814

Figure 4:
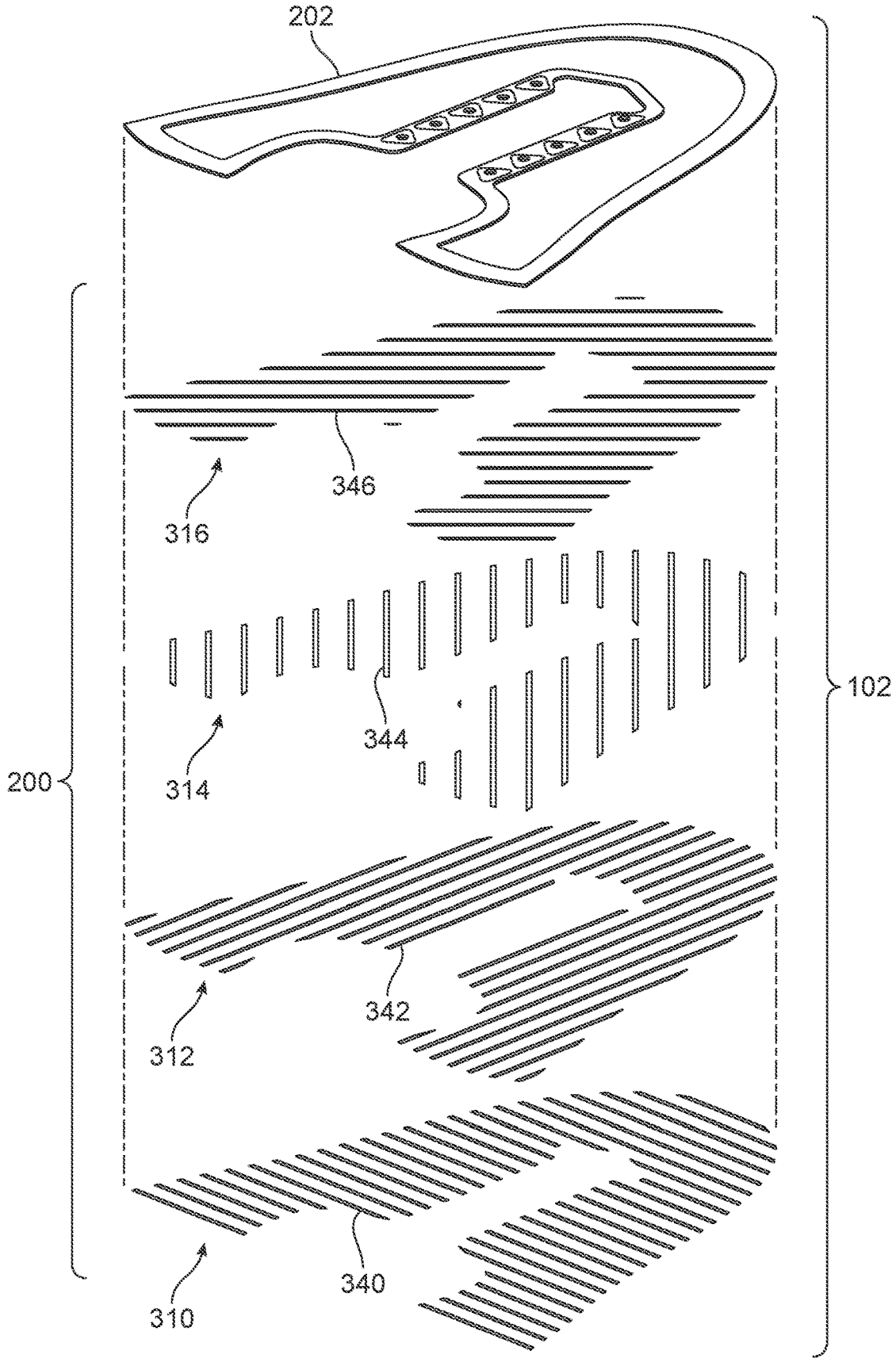
FIG. 4 is a schematic exploded view of the upper of FIG. 3.

FIG. 4 is an exploded isometric view of various layers of upper 102. Referring to FIG. 4, upper 102 includes border element 202 and ribbon structure 200. For purposes of illustration, inner mesh layer 115 (see FIG. 1) is not shown in the exploded view of FIG. 4.

A ribbon structure could be comprised of a single layer. As used herein, a layer of ribbon refers to an arrangement of one or more ribbons along an approximately two-dimensional surface. A ribbon structure could be comprised of two or more ribbon layers. In the exemplary embodiment of FIG. 4, ribbon structure 200 is comprised of four layers including first ribbon layer 310, second ribbon payer 312, third ribbon layer 314, and fourth ribbon layer 316.

In general, ribbons could be arranged in a variety of different patterns including, but not limited to, lattice patterns, grid patterns, web patterns, various mesh patterns as well as any other kinds of patterns. The type of pattern, including characteristics such as the spacing between adjacent ribbon sections, the sizes of ribbon sections (length, width, and thicknesses), and the relative arrangements of ribbon sections (stacked, woven, etc.), can be varied to achieve particular characteristics for the resulting structure including particular strength, flexibility, durability, weight, etc. It may be appreciated that using ribbons rather than cords can provide more positive engagement and more surface area to connect adjacent layers of ribbon. Furthermore, ribbons can be constructed with sufficiently small thicknesses so that the overall thickness of a ribbon structure can be kept sufficiently small, even when the ribbon structure is comprised of multiple ribbon layers that are stacked atop one another.

For purposes of clarity, each ribbon layer in FIG. 4 is shown as comprising a set of distinct ribbon sections that are arranged in parallel (and in a common plane). Moreover, each ribbon section is shown as approximately straight. However, in other cases one or more sections in each layer may be part of a continuous ribbon that winds back and forth throughout the layer. An example of ribbon layers comprised of one or more continuous ribbons that wind back is disclosed in The Tape Sections Application. Moreover, in some cases, ribbon sections could be straight and/or curved.

Different ribbon layers may be associated with different orientations. That is, each layer may be comprised of ribbon sections that extend approximately along a single direction (or axis). For example, first ribbon layer 310 is comprised of straight ribbon sections 340 that are approximately oriented along a first direction. Second ribbon layer 312 is comprised of straight ribbon sections 342 that are approximately oriented along a second direction. Third ribbon layer 314 is comprised of straight ribbon sections 344 that are approximately oriented along a third direction. Fourth ribbon layer 316 is comprised of straight ribbon sections 346 that are approximately oriented along a fourth direction.

In the exemplary embodiment of FIG. 4, the first and second directions are approximately perpendicular to one another. The third direction is oriented in a diagonal direction to the first and second directions. The fourth direction is both perpendicular to the third direction and oriented in a diagonal direction with respect to the first and second directions.

It may be appreciated that the first, second, third, and fourth directions described here may be local directions. That is, along different locations on upper 102, the absolute orientation of the directions may change (e.g., the first direction could change between being oriented in a lateral direction to being oriented at a slight angle to the lateral direction), but the relative orientations of these directions may stay substantially the same.

The orientations of the ribbon sections in each of first ribbon layer 310, second ribbon layer 312, third ribbon layer 314, and fourth ribbon layer 316 may be selected so that when these layers are assembled, they form a lattice-like pattern, as clearly seen in FIGS. 1-3. This lattice-like pattern is formed by the intersection of ribbon sections running in four different directions. The resulting gaps or openings formed between adjacent strands have a distinct triangular geometry (e.g., triangular gap 330 in FIG. 3).

The geometry of a ribbon structure may vary and different patterns, including variations in the number of layers, orientations of strands and relative spacing between ribbon sections may be selected according to intended uses of an article. A ribbon structure comprising ribbon sections that are attached at various intersection points may provide improved flexibility, comfort, and reduce pressure points when compared to conventional upper materials. A triaxial ribbon pattern (i.e., a pattern with ribbon sections running along three different directions or axes) may be useful for distributing stresses along three distinct directions, thereby reducing the stress in any single direction or axis. In the exemplary embodiment shown in FIG. 3, upper 102 incorporates a lattice with strands running in four distinct directions.

A ribbon structure may be formed by attaching one or more ribbon layers to a backing layer. In some cases, the ribbon layers may each be embroidered to the backing layer. Specifically, a first ribbon layer may be embroidered onto a backing layer. Then, a second ribbon layer may be embroidered onto the first ribbon layer and the backing layer. Then, a third ribbon layer may be embroidered onto the second ribbon layer, the first ribbon layer, and the backing layer.

Ribbons can be attached to substrate materials using any of the principles, methods, systems, and teachings disclosed in any of the following applications: Berns et al., U.S. Patent Application Publication Number 2016/0316856, published Nov. 3, 2016 and titled "Footwear Upper Including Strand Layers"; Berns et al., U.S. Patent Application Publication Number 2016/0316855, published Nov. 3, 2016 and titled "Footwear Upper Including Variable Stitch Density"; and Berns et al., U.S. Patent Application Publication Number 2015/0272274, published Oct. 1, 2015 and titled "Footwear Including Textile Element," the entirety of each application being herein incorporated by reference. Embodiments can use any known systems and methods for feeding ribbon to an embroidery or sewing machine including any of the systems and/or methods described in Miyachi et al., U.S. Pat. No. 5,673,639, issued Oct. 7, 1997 and titled "Method of feeding a piece of tape to a belt loop sewing machine and ribbon feeder for effecting same," the entirety of which is herein incorporated by reference.

The technique of stitching the ribbon sections to a substrate may vary. The stitch technique used may include chain stitch, double chain stitch, the buttonhole or blanket stitch, the running stitch, the satin stitch, the cross stitch, or any other stitch technique known in the art. Also, a combination of known stitch techniques may be used. These techniques may be used individually or in combination to stitch either individual ribbon sections or groups of ribbon sections in place.

The stitches may form a pattern. When the stitching is performed by a machine, the machine may use a computer-generated program to control the stitching, including the locations of the stitching relative to an underlying substrate, as well as how and which ribbon sections to feed, how to stitch the ribbon sections, and the technique of stitching used.

In some cases, only a single type of ribbon is stitched using a machine. In other cases, multiple types of ribbon may be stitched using the same ribbon-feeding assembly. In still other cases, an embroidery device may have multiple feeding assemblies to embroider multiple ribbon sections at the same time.

The method of stitching used to attach one or more ribbon sections may vary. Thread could be stitched around a ribbon section, thereby securing the ribbon in place on a substrate layer. That is, the thread could be stitched to the backing layer on one side of the ribbon section, passed over the opposing side of the ribbon section and then stitched to the backing layer, such that the stitch never passes through the ribbon section. Alternatively, thread could be stitched directly through a ribbon section. A ribbon section could have preconfigured holes for receiving stitches. Alternatively, a needle may pierce a ribbon section to place a stitch through the ribbon section.

Upper 102 may be formed as follows. First, each layer of ribbon is laid down and stitched (or otherwise affixed) to a backing layer. Wherever two ribbon sections cross, they are stitched together to form nodes in the resulting ribbon structure. Once the layers have been fixed in place, the backing layer may be optionally removed, for example, by dissolving the backing layer. Methods for stitching down ribbon sections and also for dissolving backing layers are discussed in further detail in The Tape Sections Application, and any of these methods could be used in forming ribbon structure 200.

Figure 5:
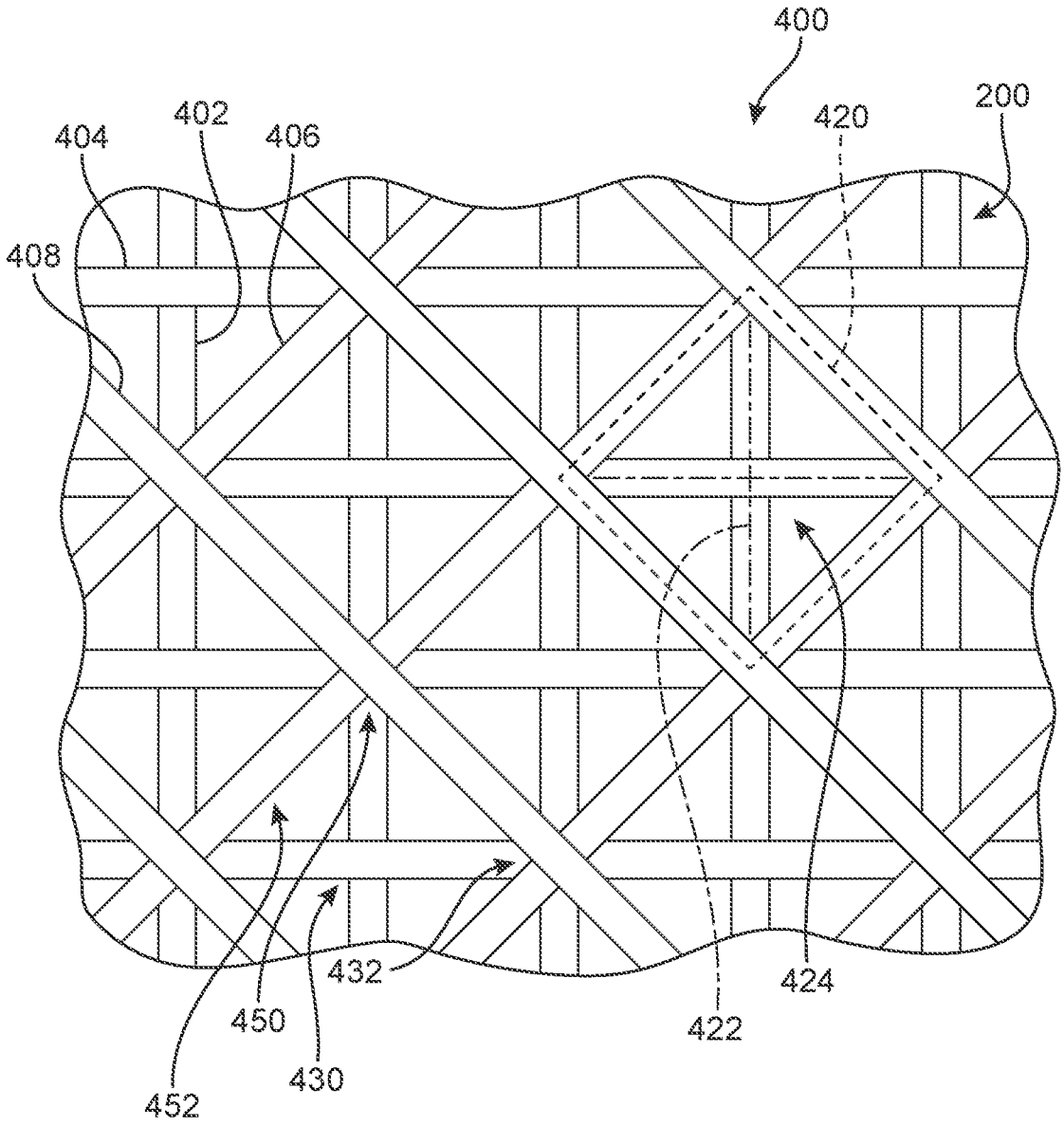
FIG. 5 is a schematic enlarged view of a portion of a ribbon structure, according to an embodiment.

FIG. 5 is a schematic view of an embodiment of portion 400 of ribbon structure 200. Portion 400 is seen to include various ribbon sections from each of the four layers of ribbon structure 200. Within each layer, the ribbon sections seen in portion 400 are approximately parallel to one another. These include first set of ribbon sections 402 from first ribbon layer 310, second set of ribbon sections 404 of second ribbon layer 312, third set of ribbon sections 406 from third ribbon layer 314, and fourth set of ribbon sections 408 from fourth ribbon layer 318.

As seen in FIG. 5, first set of ribbon sections 402 and second set of ribbon sections 404 are oriented in perpendicular directions to one another. Likewise, third set of ribbon sections 406 and fourth set of ribbon sections 408 are oriented in perpendicular directions to one another. Moreover, third set of ribbon sections 406 and fourth set of ribbon sections 408 form rectangular grid with first set of ribbon sections 402 and second set of ribbon sections 404 forming diagonals that intersect the rectangular grid.

In some cases, the pattern of ribbon structure 200 may be characterized as comprising repeating units of rectangles 420 with X-shaped elements 422 centered within rectangles 420. Moreover, the pattern includes four triangular openings 424 formed in the gaps between adjacent ribbon sections.

Ribbon structure 200 may be characterized as comprising a set of nodes that are connected by links. Specifically, a node is associated with any location where two or more ribbon sections overlap and are attached (e.g., via stitching). As used herein, the term "link" refers to a portion of ribbon (e.g., a "ribbon portion") that extends between two adjacent nodes. A section of ribbon, as discussed below, may comprise multiple such links arranged in a linear manner. Thus, in FIG. 5, ribbon structure 200 is seen to comprise set of nodes 450 that are joined together by set of links 452.

Nodes may be associated with the intersection (and attachment) of only two ribbon sections. Nodes may be associated with the intersection (and attachment) of three or more ribbon sections. Nodes may be associated with the intersection (and attachment) of four or more ribbon sections.

Ribbon structure 200 comprises two types of nodes: first type of node 430 and second type of node 432. First type of node 430 is formed at locations where only first set of ribbon sections 402 and second set of ribbon sections 404 intersect. Second type of node 432 is formed at locations where all four sets of ribbon sections intersect, including first set of ribbon sections 402, second set of ribbon sections 404, third set of ribbon sections 406, and fourth set of ribbon sections 408.

Because set of links 452 are comprised of relatively flexible portions of ribbon, adjacent nodes may be capable of moving substantially independently of one another. Moreover, as described in further detail below, this arrangement may allow for ribbon structure 200 to provide strength for the foot along one direction while remaining relatively slack or neutral (i.e., not in tension) in a second direction.

The following describes possible configurations and dynamics of a ribbon structure. It may be appreciated that a ribbon structure may be attached to a backing layer. A backing layer may be made of a material that is sufficiently elastic and/or flexible in multiple different directions (e.g., a knit or stretch fabric) so that the backing layer does not impede the dynamic motion of the ribbon structure during use.

Generally, nodes on a ribbon structure may move independently from one another. The embodiments discussed below and shown, for example, in FIGS. 6-13, 17 and 20, depict schematic configurations of links connected to one another by nodes. It may be appreciated that these configurations may pertain to the arrangement of portions of ribbon (i.e., the links) that extend between a plurality of nodes (i.e., the intersections of different ribbon sections). For purposes of illustration the links are shown with a particular width, however, it may be appreciated that in various embodiments the width of a ribbon portion or section could vary.

Figure 6:
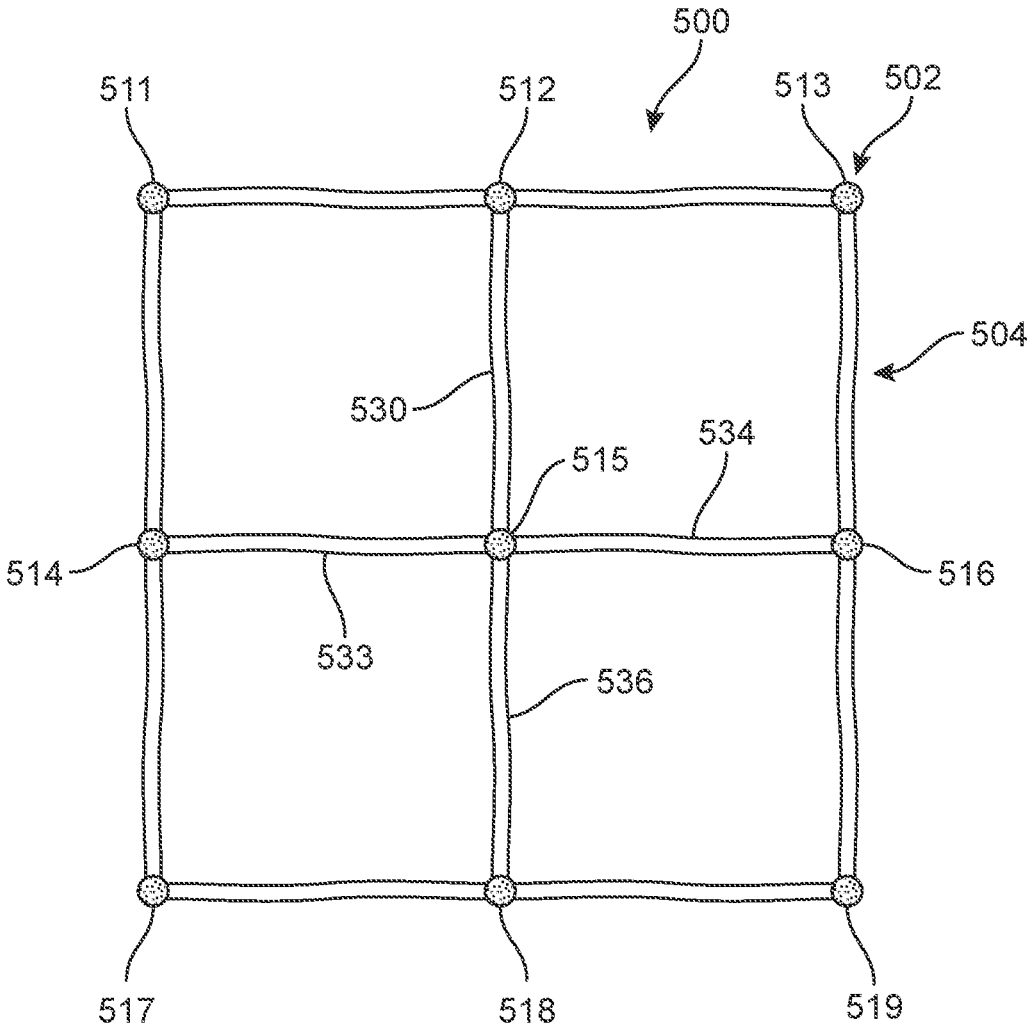
FIGS. 6-13 are schematic views of a grid comprising links and nodes in various configurations, according to an embodiment.

FIG. 6 is a schematic view of grid 500 of nodes 502 connected to one another by flexible links 504. Flexible links 504 can transfer forces between adjacent nodes under tension as the links tend to become taut under tension. However, as compressive forces are applied, flexible links 504 will bend or buckle to allow adjacent nodes to move closer together. This results in ribbon structures that provide strength along directions where tension is applied, while also allowing the ribbon to bend, fold, or contract in directions where tension is not applied.

Referring to FIG. 6, grid 500 is intended to represent possible motion or dynamics for a simplified ribbon structure (comprised in this case of only 2 sets of perpendicular ribbon sections intersecting at the nodes). In some cases, nodes 502 includes first node 511, second node 512, third node 513, fourth node 514, fifth node 515, sixth node 516, seventh node 517, eighth node 518, and ninth node 519, connected to their neighbors by flexible links 504. FIGS. 7-11 depict how fifth node 515 (i.e., the central node) can move substantially independently of adjacent nodes.

Figure 7:
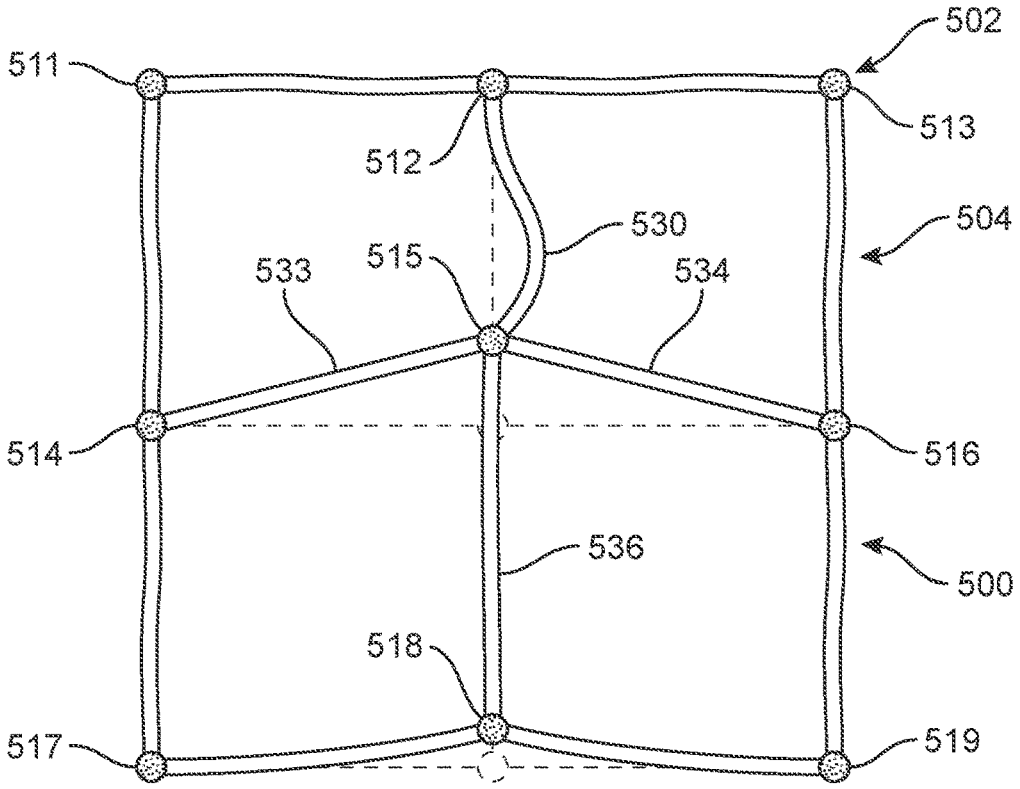
Figure 8:
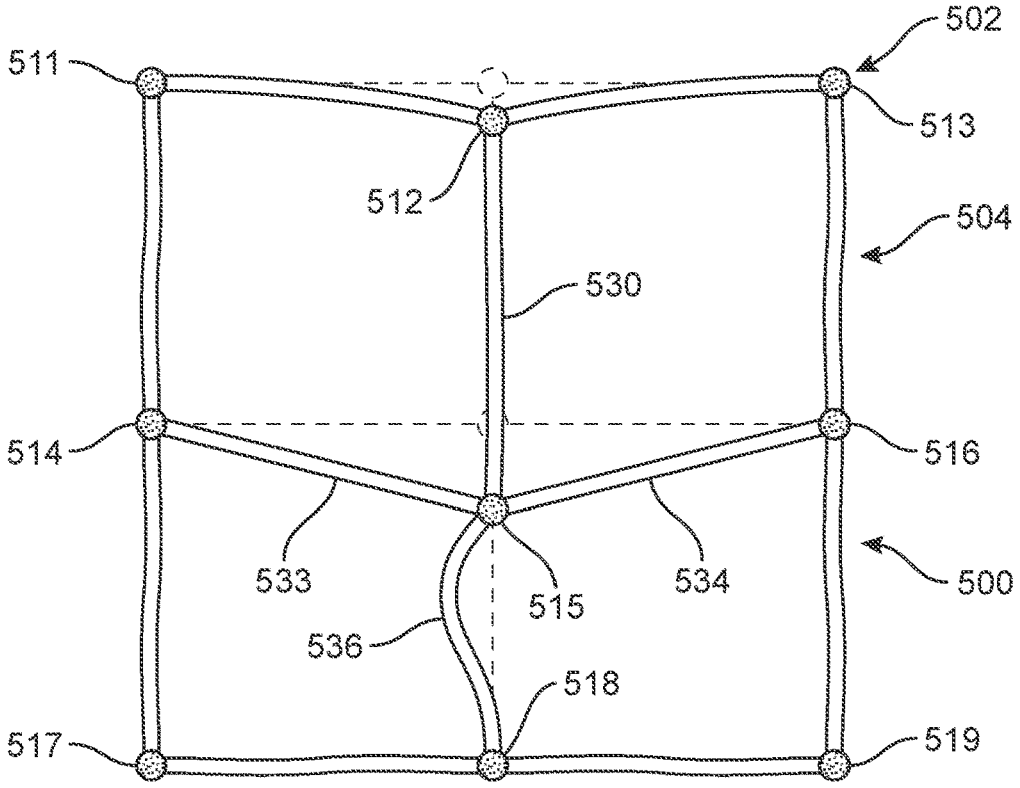
Figure 9:
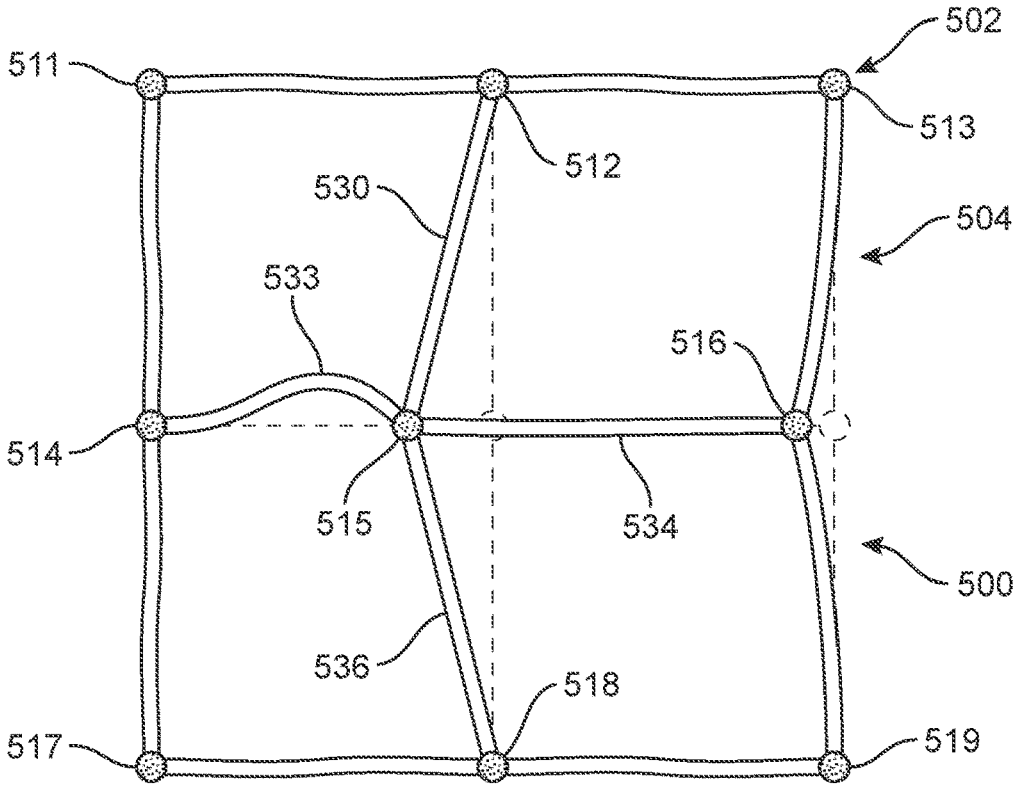
Figure 10:
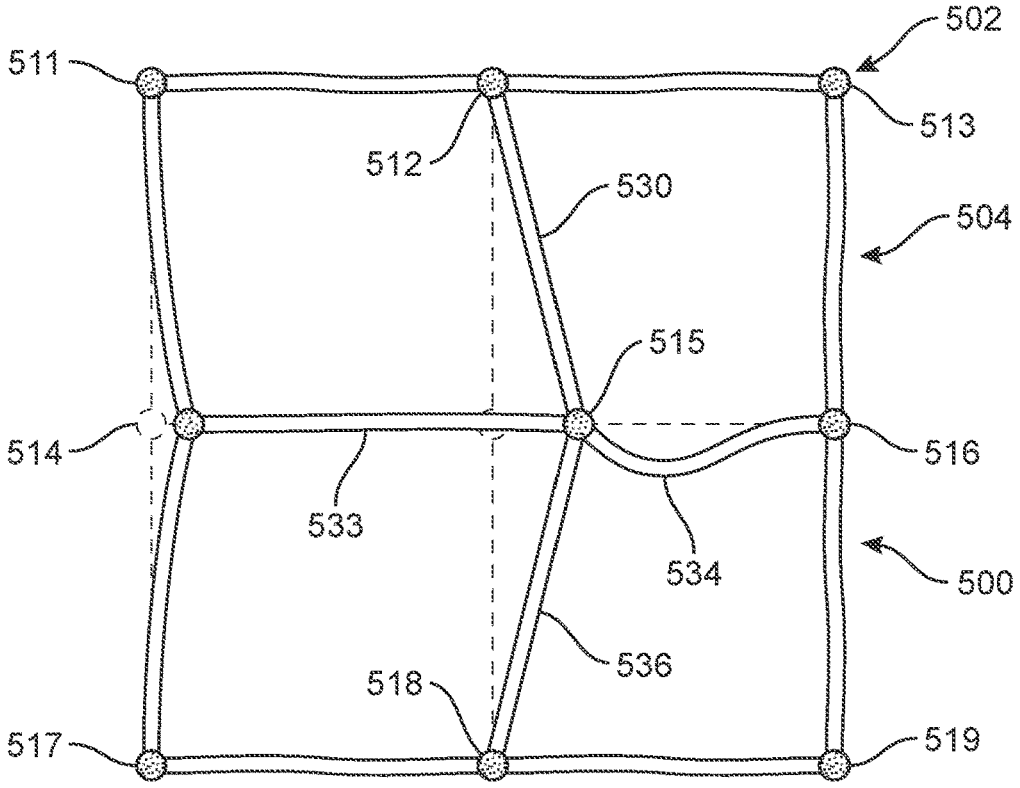
Figure 11:
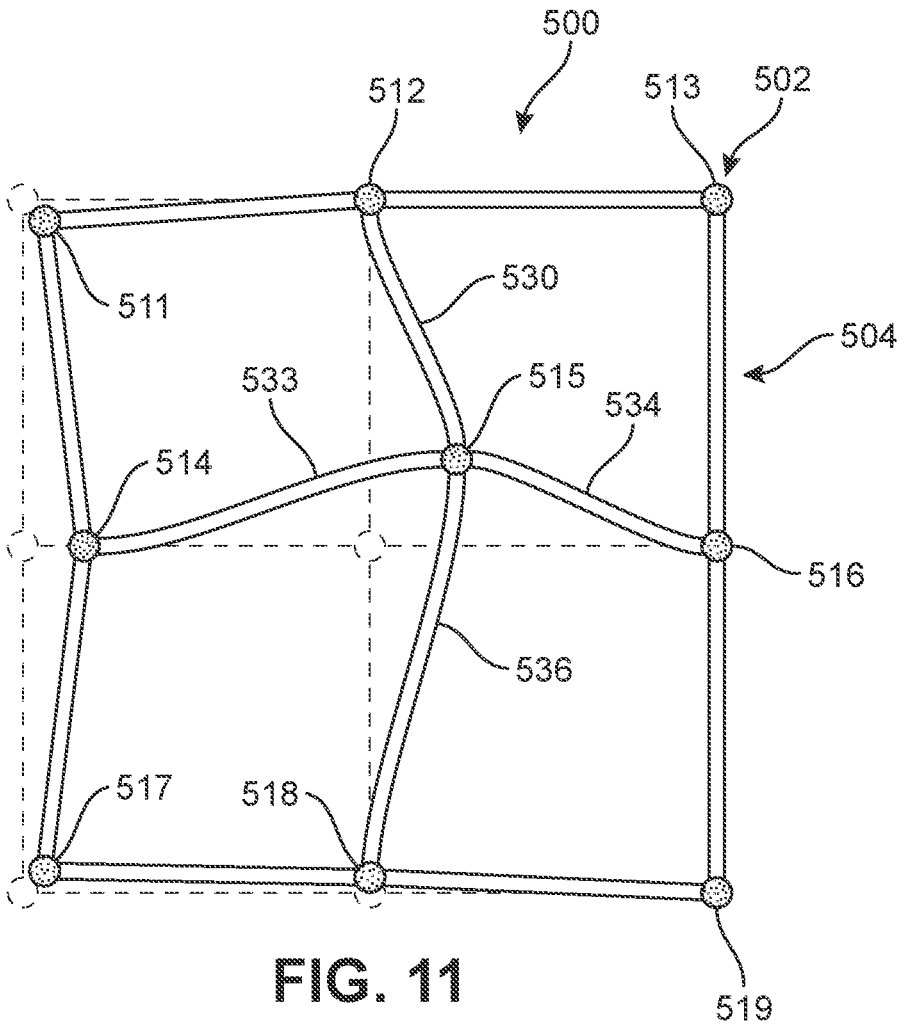

As an example, in FIG. 7, fifth node 515 has moved a small distance toward second node 512. To accommodate this motion, link 530 between fifth node 515 and eighth node 518 bends so that the two nodes can move closer. Additionally, link 533 between fifth node 515 and fourth node 514, link 534 between fifth node 515 and sixth node 516 and link 536 between fifth node 515 and eighth node 518 all stretch a bit under tension. In some cases, fourth node 514, sixth node 516, and eighth node 518 may all move slightly under tension; however, they may be displaced by a smaller degree than fifth node 515 since nodes 502 are capable of some stretching. Similar motions of fifth node 515 toward each of fourth node 514, sixth node 516, and eighth node 518 are shown in FIGS. 8-11. Moreover, an exemplary configuration where fifth node 515 is moved toward third node 513 is also indicated in FIG. 11. It may be further understood that fifth node 515 can move in any other direction in the plane of grid 500.

Figure 12:
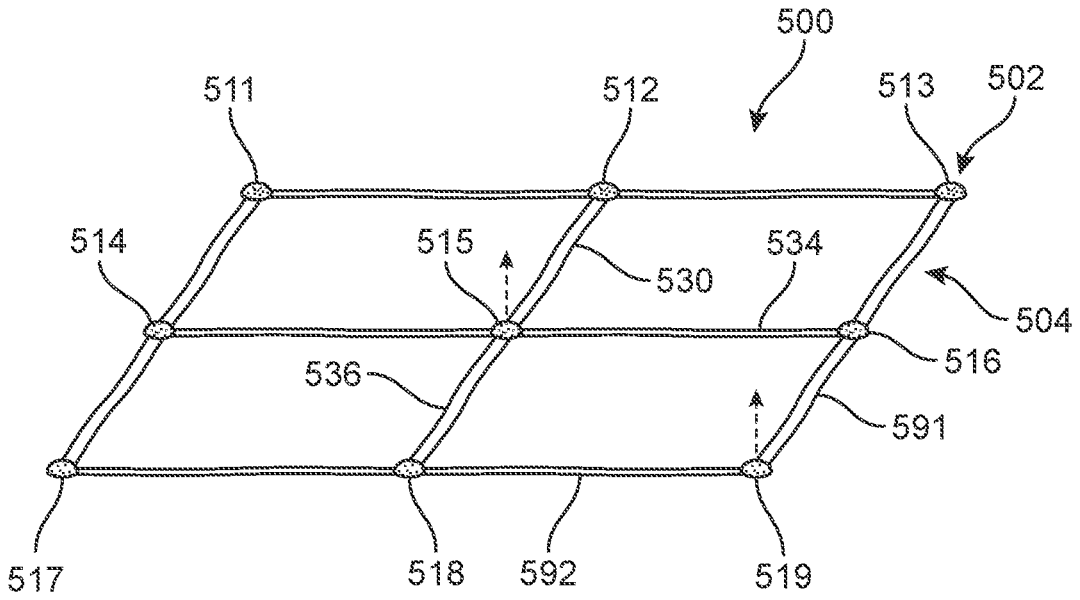
Figure 13:
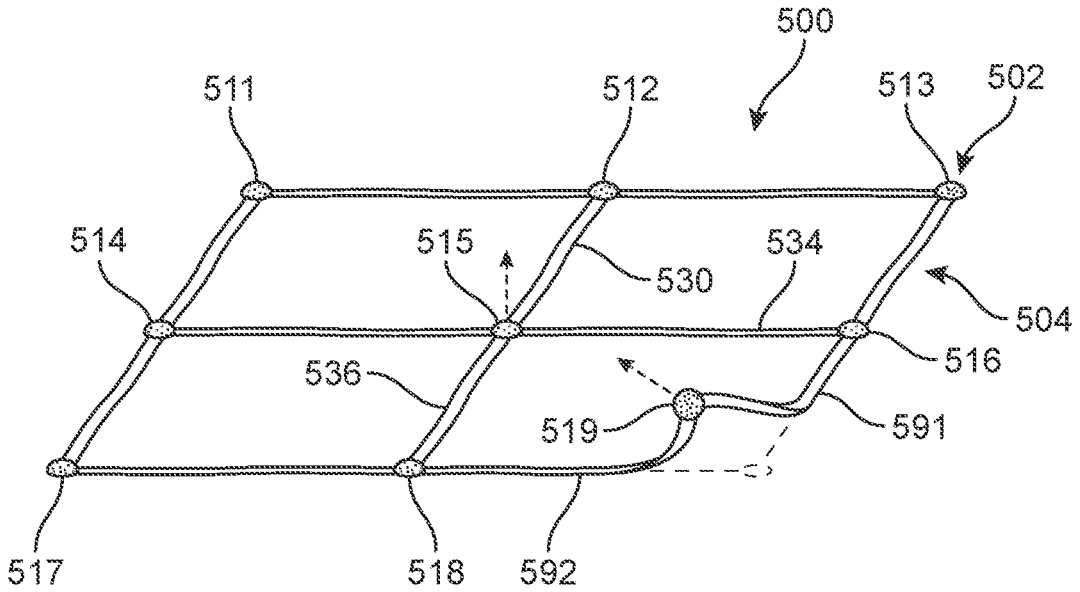

FIGS. 12-13 depicts a situation where ninth node 519 is lifted from an initial position in a common plane with the other nodes of grid 500. As seen in FIG. 13, ninth node 519 can be lifted up out of the plane without displacing the other nodes in grid 500 from the plane. In some cases, ninth node 519 may be moved substantially closer to fifth node 515 as it is lifted. Not only is ninth node 519 lifted up but it may be turned towards fifth node 515. More specifically, the orientation of ninth node 519 in the configuration of FIG. 13 may be changed so that it points in a different direction from its initial orientation (e.g., facing in a vertical direction) as depicted in FIG. 12. This is in contrast to the other nodes (e.g., node 515) which may maintain a substantially constant orientation between the two configurations shown in FIGS. 12-13.

As used herein, the orientation of a node is intended to mean the orientation of its surface along, for example, an outer side of the ribbon structure. In some case, the orientation may refer to the direction that a normal vector extending from the outer node surface may point.

This type of relative movement is facilitated by the flexible links (e.g., the ribbon portion or link 591 that extends from node 516 to node 519 in FIG. 13 and the ribbon portion or link that extends from node 518 to node 519) that can bend and twist, thereby facilitating substantially independent motion of adjacent nodes. In the exemplary embodiment of FIGS. 12-13 this relative motion occurs between nodes located at opposing diagonals of a rectangular set of links and nodes, comprising node 515, node 516, node 518 and node 519 as well as their connecting links (i.e., link 534, link 591, link 592 and link 536).

For clarity, the exemplary embodiments of FIGS. 12-13 depict motion of one node while the set of links and nodes are arranged in a substantially flat surface configuration. However, similar kinds of relative motions could occur even when the set of links and nodes are initially arranged along a curved surface, as may occur when an upper with links and nodes is worn on a foot. In such a situation the relative orientations of one or more nodes can be changed without changing the orientations of one or more other adjacent nodes. That the relative orientations of the nodes can change in this manner may facilitate better fit as the nodes can independently conform (in their orientation) with the local curvature of the foot.

Thus, from the potential kinds of motions for individual nodes depicted in FIGS. 7-13, it may be appreciated that grid 500 can accommodate a wide variety of geometric configurations. Moreover, a ribbon structure comprising a similar arrangement of links and nodes may likewise be able to accommodate a wide variety of geometric configurations. This may help an upper that incorporates such a ribbon structure to provide improved fit and comfort over traditional upper materials.

Figure 15:
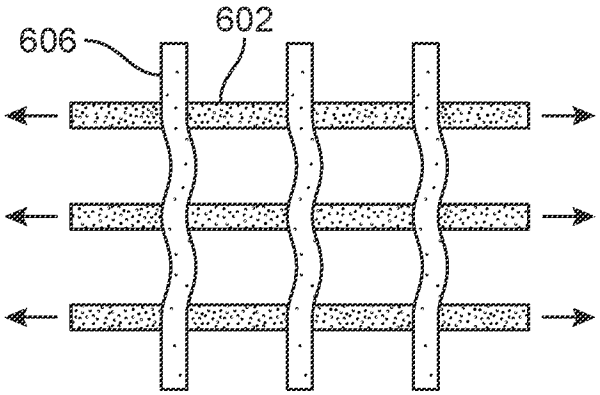
FIG. 14-16 are schematic views of a portion of a ribbon structure in various configurations, according to an embodiment.
Figure 14:
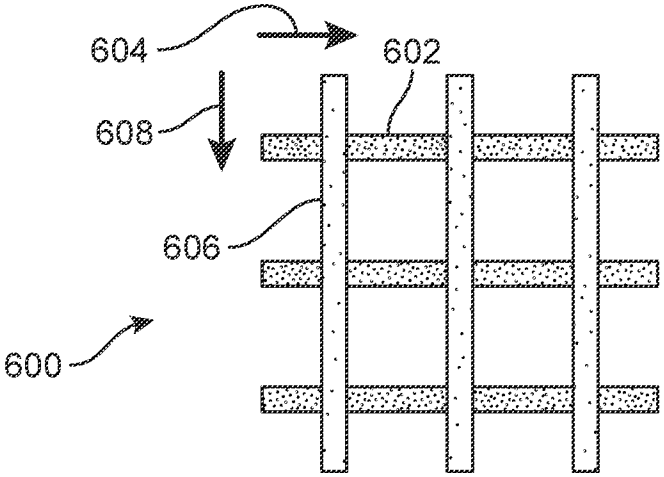
Figure 16:
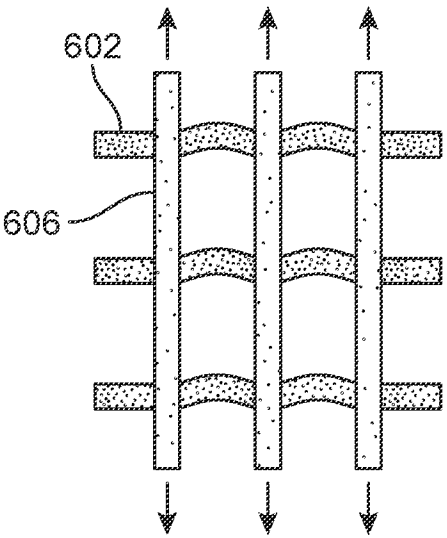

FIGS. 14-16 depict schematic configurations of a portion of ribbon structure 600 that is comprised of only first set of ribbon sections 602 (extending in first direction 604) and second set of ribbon sections 606 (extending in second ribbon direction 608). In FIG. 14, ribbon structure 600 is in a relaxed or neutral configuration. In FIG. 15, a tensioning force has been applied to first set of ribbon sections 602, which acts to stretch or make taut these sections. Although first set of ribbon sections 602 is under tension, second set of ribbon sections 606 is in a slack or neutral state. In fact, as seen in FIG. 15, the distance between adjacent ribbon sections in second set of ribbon sections 606 has been reduced between the configurations of FIG. 14 and FIG. 15. This demonstrates that ribbon structure 600 is capable of bending, folding, sagging, or otherwise relaxing in second ribbon direction 608 even while ribbon structure 600 provides strength under tension along first direction 604. Likewise, as seen in FIG. 16, this configuration can be reversed, with ribbon structure 600 sagging or relaxing in first direction 604 while ribbon structure 600 provides strength under tension along second ribbon direction 608.

Of course, the embodiments depicted in FIGS. 14-16 may apply to ribbon structures with two perpendicular sets of ribbons. In contrast, FIGS. 17-19 depict another embodiment that includes four sets intersecting of ribbons as are utilized in the embodiment of ribbon structure 200.

Figure 17:
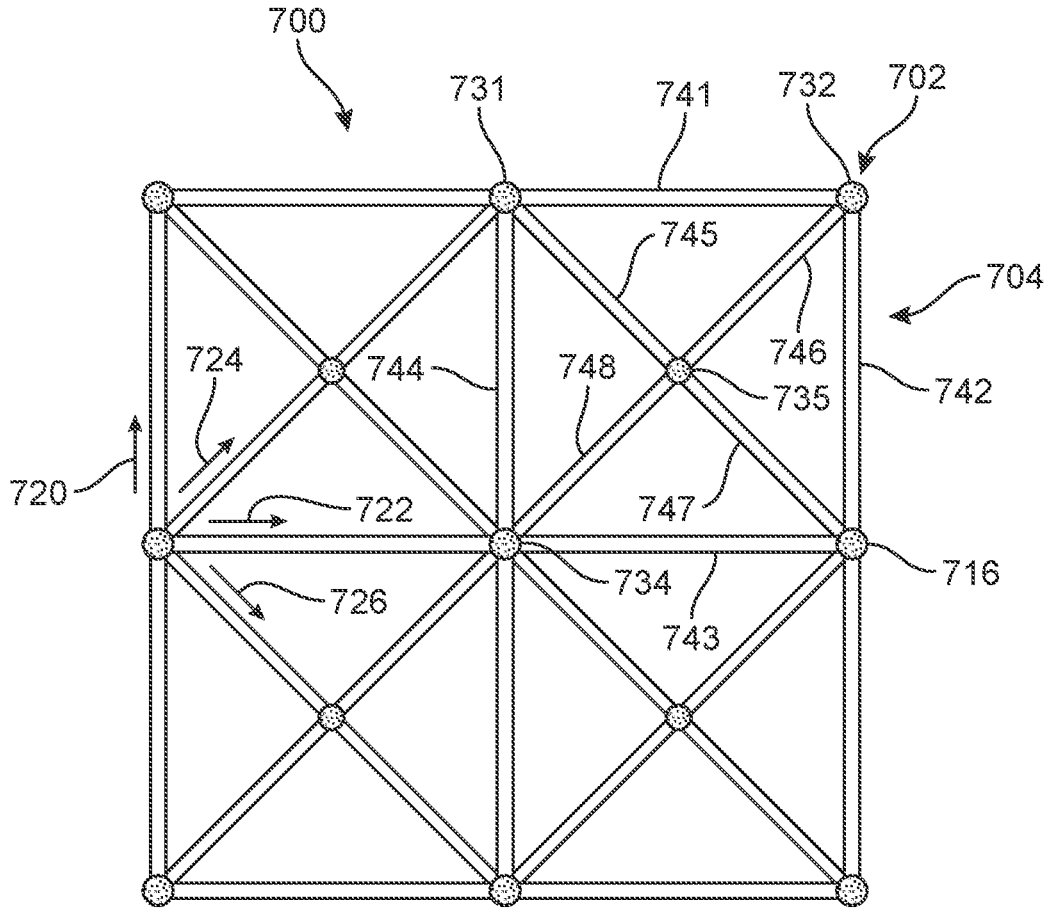
FIG. 17 is a schematic view of another embodiment of a grid comprising links and nodes.

Referring first to FIG. 17, a schematic representation of grid 700 comprising set of nodes 702 and links 704 is shown. In this case, grid 700 includes links extending in four different directions: first direction 720, second direction 722, third direction 724, and fourth direction 726. Moreover, whereas grid 500 comprised units of four nodes arranged in rectangles, grid 700 includes units of three nodes arranged in triangles (which are themselves arranged into rectangles). As seen in FIG. 17, grid 700 includes first node 731, second node 732, third node 733, fourth node 734, and a fifth node 735. First node 731 and second node 732 are connected by first link 741. Second node 732 and third node 733 are connected by second link 742. Third node 733 and fourth node 734 are connected by third link 743. First node 731 and fourth node 734 are connected by fourth link 744. Thus, first node 731, second node 732, third node 733, and fourth node 734 are connected in a rectangular geometry by their connecting links. In addition, fifth node 735 is disposed centrally within the rectangle and is connected to each of the other four nodes by another link. Specifically, fifth node 735 is connected to first node 731 by fifth link 745, to second node 732 by sixth link 746, to third node 733 by seventh link 747, and to fourth node 734 by eighth link 748.

Figure 19:
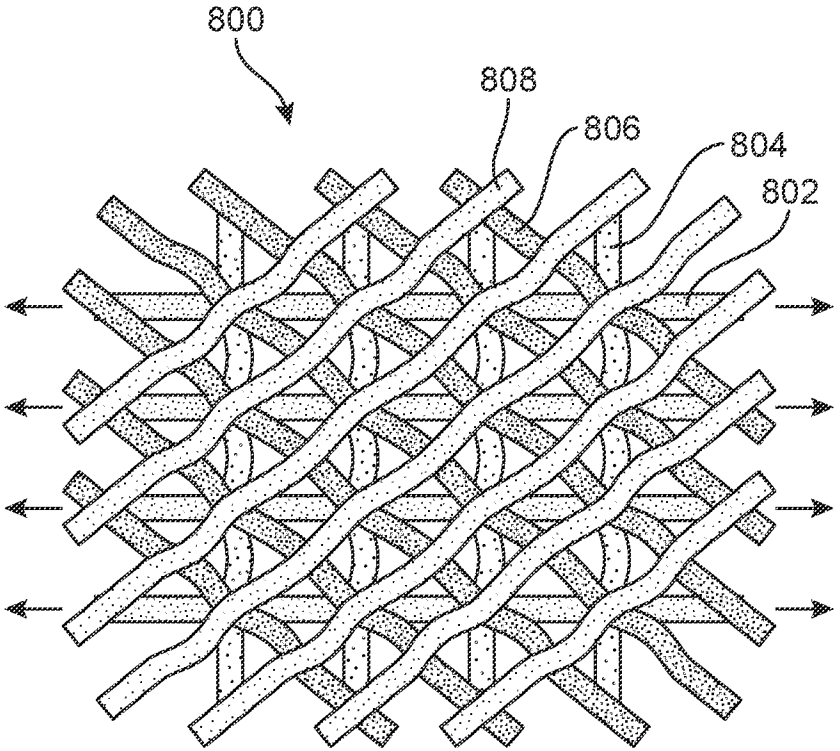
FIGS. 18-19 are schematic views of a portion of a ribbon structure in various configurations, according to another embodiment.
Figure 18:
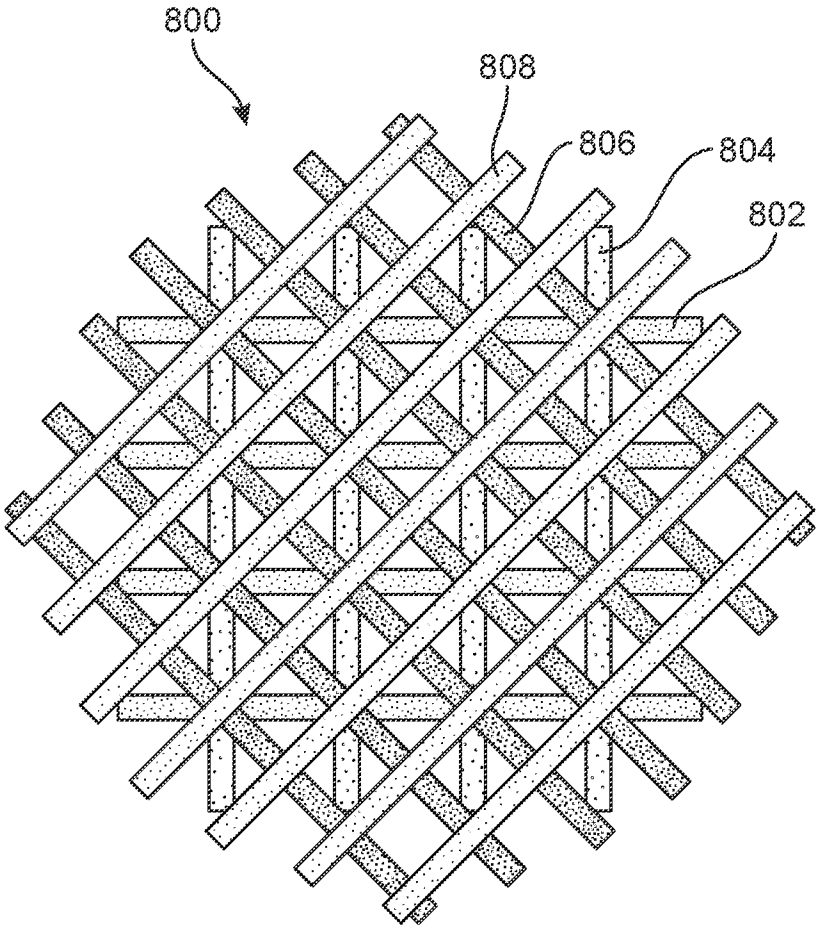
Figure 20:
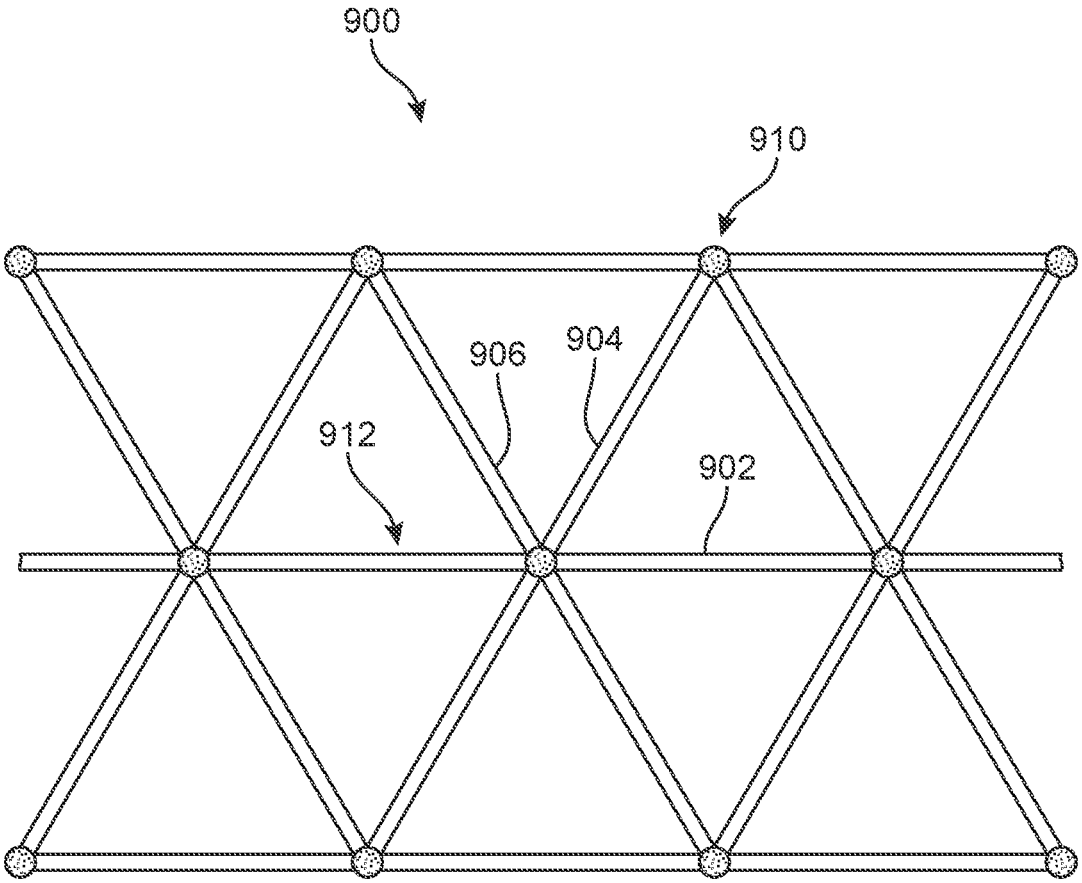
FIG. 20 is a schematic view of another embodiment of a grid comprising links and nodes.

FIGS. 18-19 depict schematic configurations of a portion of ribbon structure 800 that is comprised of first set of ribbon sections 802 (extending in a first direction), second set of ribbon sections 804 (extending in a second direction), third set of ribbon sections 806 (extending in a third direction), and fourth set of ribbon sections 808 (extending in a fourth direction). In FIG. 18, ribbon structure 800 is in a relaxed or neutral configuration. In FIG. 19, a tensioning force has been applied to first set of ribbon sections 802, which acts to stretch or make taut these sections. Although first set of ribbon sections 802 are under tension, second set of ribbon sections 804 are in a slack or neutral state. In fact, as seen in FIG. 19, the distance between adjacent ribbon sections in second set of ribbon sections 804 has been reduced between the configurations of FIG. 18 and FIG. 19. In addition, with first set of ribbon sections 802 under tension, third set of ribbon sections 806 and fourth set of ribbon sections 808 may also be in a slack or neutral state. This demonstrates that ribbon structure 800 is capable of bending, folding, sagging, or otherwise relaxing even while ribbon structure 800 provides strength under tension along the direction of first set of ribbon sections 802.

As previously discussed, a ribbon structure could incorporate any number of layers with ribbon sections oriented in any direction. In another embodiment, depicted in FIG. 20, a portion of ribbon structure 900 is configured with three ribbon layers that are arranged in a triaxial ribbon pattern. In this case, first set of ribbon sections 902, second set of ribbon sections 904, and third set of ribbon sections 906 are all arranged in different directions from one another. Moreover, the ribbon sections from the different layers intersect at set of nodes 910. Set of nodes 910 are further connected by set of links 912 (i.e., portions of the ribbon sections). As in the previous embodiments depicted in FIGS. 6-19, each node in set of nodes 910 may move relative to adjacent nodes. This arrangement facilitates tensioning along one direction while allowing for the possibility of slack in the remaining two directions.

Figure 21:
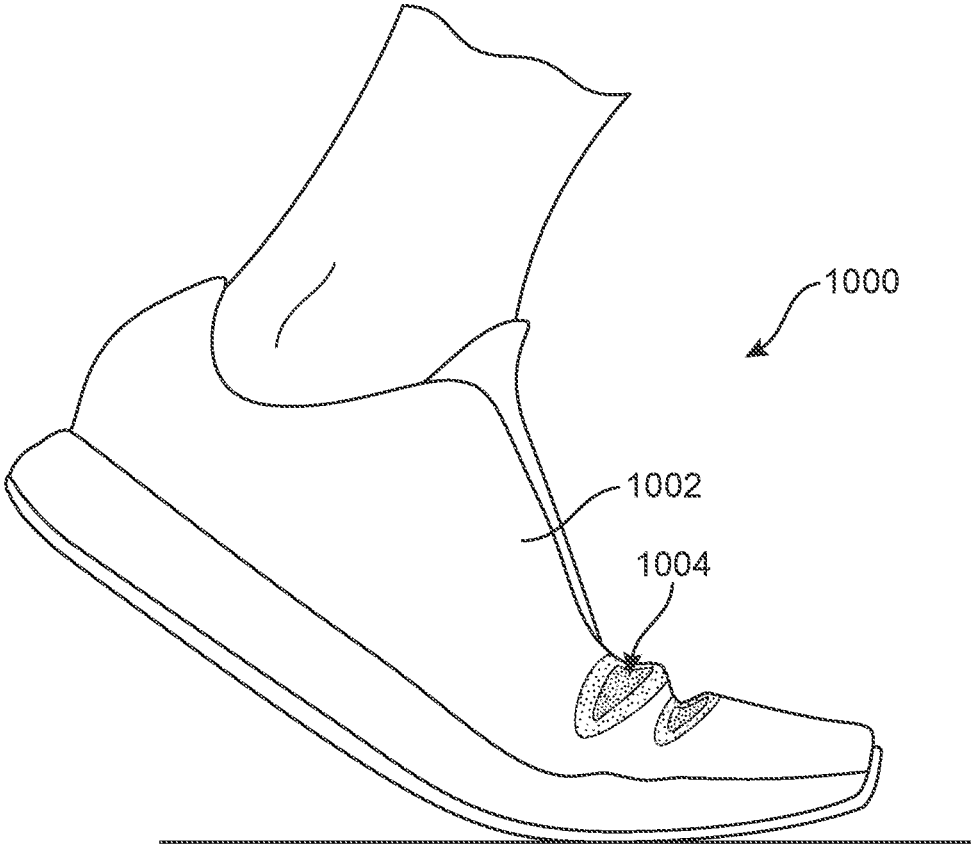
FIGS. 21 and 22 are schematic views of another embodiment of an article.

FIG. 21 is a schematic side view of an article of footwear 1000 that incorporates a synthetic or woven upper 1002. In some cases, woven or synthetic materials may provide sufficient stiffness to support the foot, but this stiffness can also lead to undesirable effects as well. In FIG. 21, for example, as article 1000 bends forward along the ball of the foot, upper 1002 may buckle along the region of bending. This may result in one or more pressure points 1004 where upper 1002 is pushed into the top of the foot as it bends.

Figure 22:
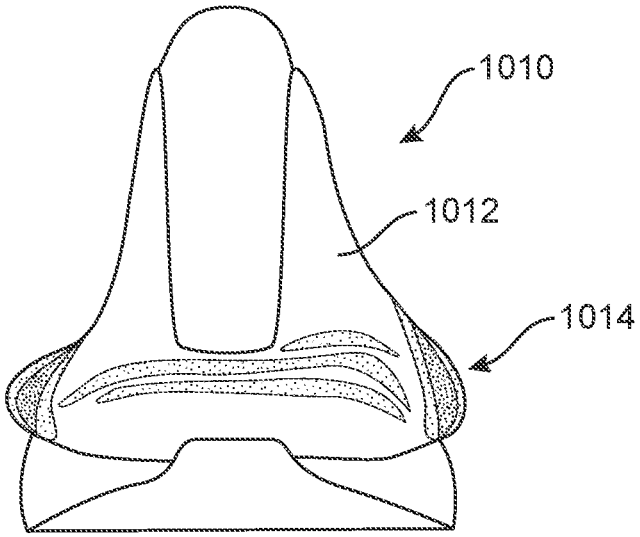

FIG. 22 is a schematic front view of another article of footwear 1010 that incorporates a knit or stretch fabric upper 1012. In some cases, knit or stretch fabrics may adapt to the shape of the foot during use, which may lessen pressure points as occurred with upper 1002 shown in FIG. 21. However, upper 1012 may not provide sufficient strength to hold in the foot during various kinds of activities. In some cases, this may result in the lower periphery 1014 of upper 1012 spilling out over the midsole (along with the foot), which may affect stability.

Figure 23:
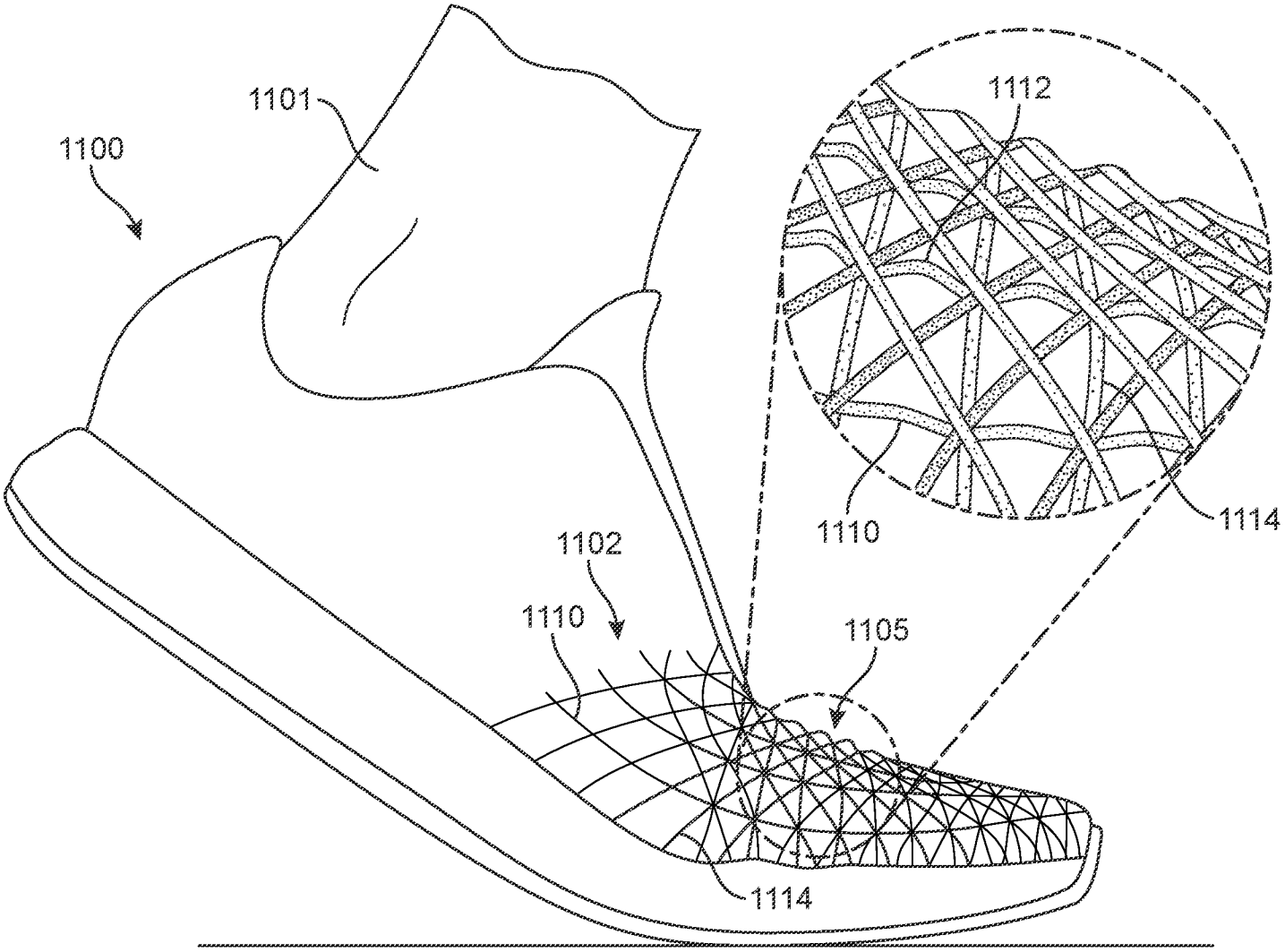
FIGS. 23-24 are schematic views of an embodiment of an article of footwear with a ribbon structure as a foot bends at the instep.
Figure 24:
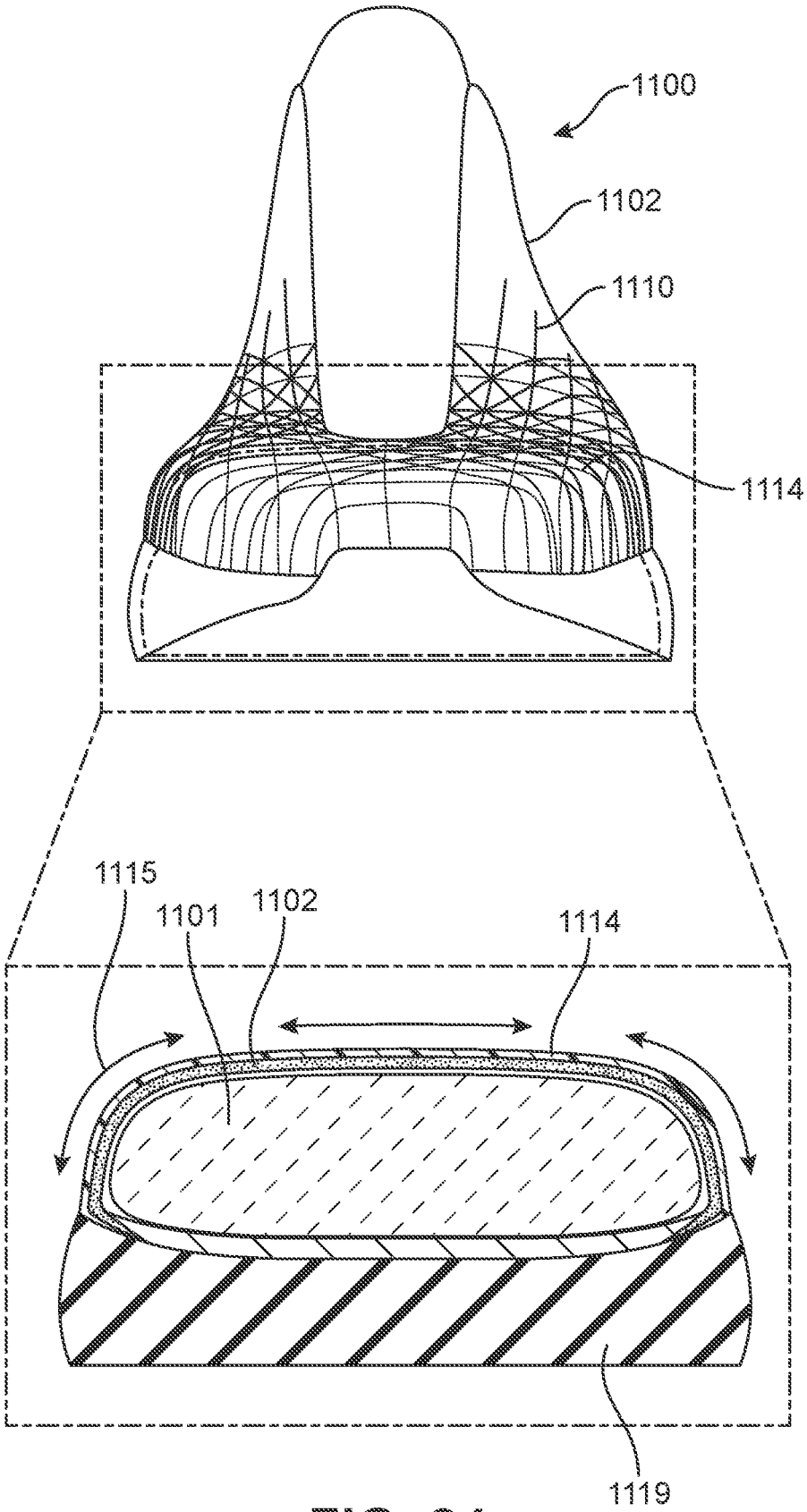

In contrast to conventional upper structures, an upper with a ribbon structure may be configured to provide sufficient strength/support without sacrificing comfort. An upper with a ribbon structure may provide sufficient strength/stiffness along one direction while limiting stiffness in other directions to maintain comfort. For example, FIGS. 23-24 illustrate a schematic view of article 1100 with ribbon structure 1102 as foot 1101 is bent forward. In this case, as foot 1101 bends first set of ribbon sections 1110 of ribbon structure 1102, which are oriented in an approximately longitudinal direction, flex to accommodate the bend at instep 1105. In particular, links 1112 oriented along the longitudinal direction may bend or fold so that ribbon structure can compress at the instep. This prevents the formation of pressure points since the ribbon structure lacks strength in this direction to push down against the top of the foot.

Referring to FIGS. 23-24, article 1100 also includes second set of ribbon sections 1114 that are oriented circumferentially around the upper (including sections extending vertically and other sections extending laterally). As the forefoot of article 1100 contacts the ground, foot 1101 may tend to expand in a widthwise/lateral direction. This expansion places second set of ribbon sections 1114 in tension, which are seen to be taut in FIGS. 23-24. In this configuration, second set of ribbon sections 1114 provide sufficient strength in the circumferential directions 1115 around the upper (e.g., vertical/lateral directions) to keep foot 1101 securely on midsole 1119. As the foot flattens back out following bending, the tensioned links may return to their default configuration that includes some slack.

Figure 25:
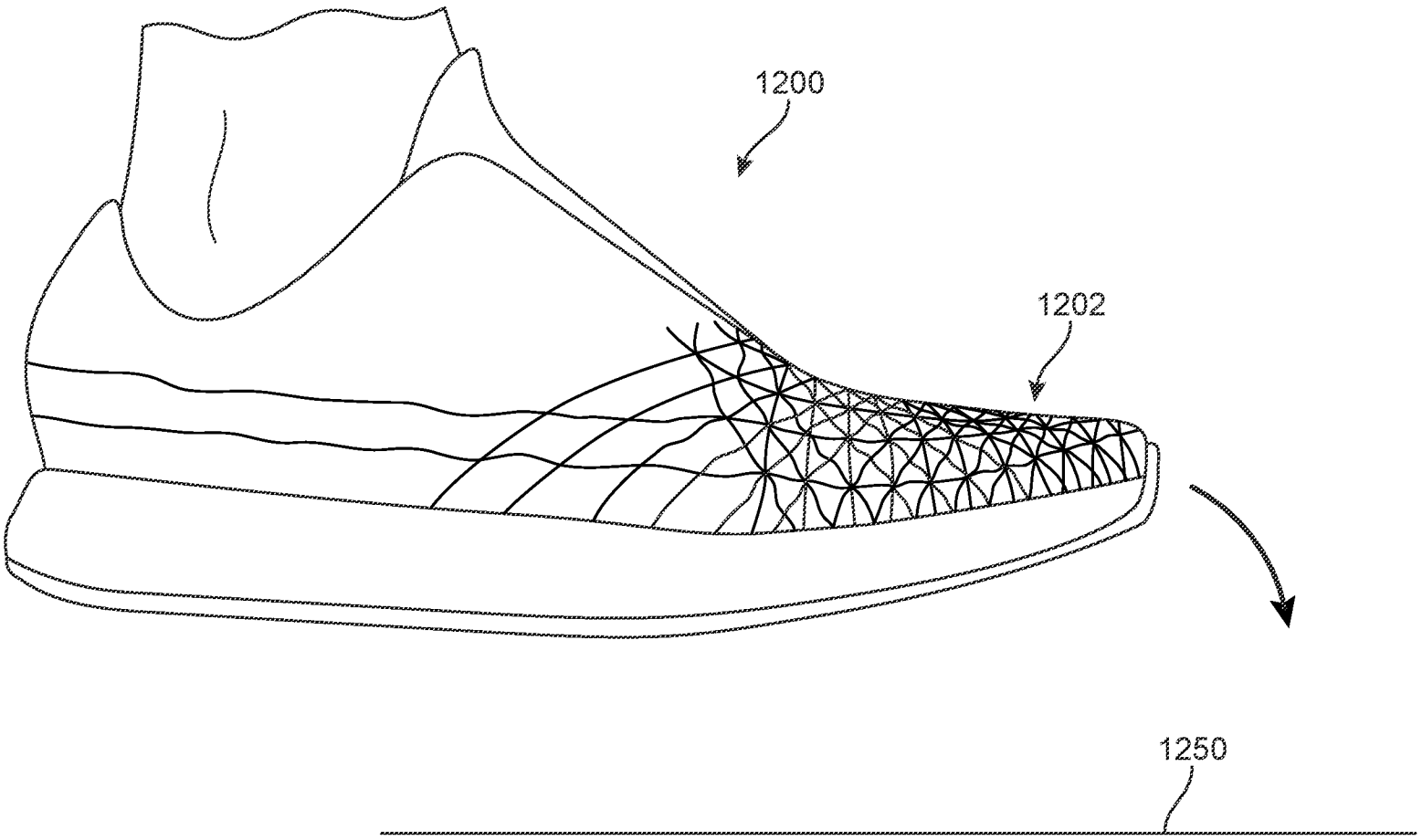
FIGS. 25-26 are schematic views of an embodiment of an article of footwear with a ribbon structure as longitudinal forces are applied to the upper.
Figure 26:
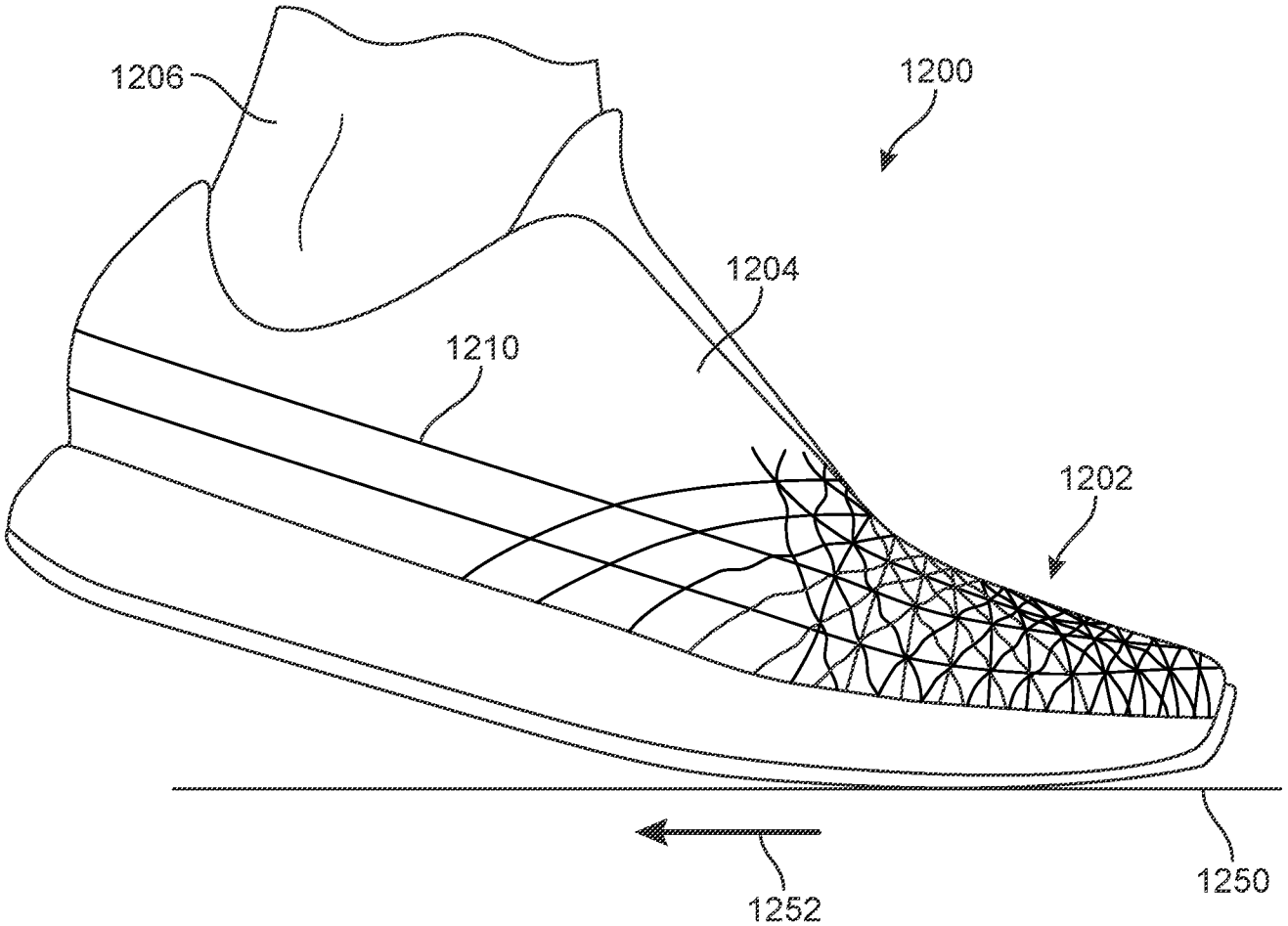

In another example, depicted in FIGS. 25 and 26, article 1200 includes ribbon structure 1202 that may help with longitudinal strength as a user comes to a stop. In FIG. 25, article 1200 is moving down toward ground surface 1250. At this point, ribbon structure 1202 is not tensioned in any particular direction. In FIG. 26, article 1200 contacts ground surface 1250, and frictional force 1252 acts to slow article 1200 down. At this point, first set of longitudinal ribbon sections 1210 may be placed in tension to help keep upper 1204 tight against foot 1206.

A ribbon structure could be disposed through a portion of an upper or through the entirety of an upper. Referring back to the embodiment of FIGS. 1-2 for reference, a ribbon structure could be disposed only in forefoot region 101. A ribbon structure could be disposed only in midfoot region 103. A ribbon structure could be disposed only in heel region 105. Generally, a ribbon structure could be disposed in any combination of forefoot region 101, midfoot region 103, and heel region 105.

In contrast to strands or other substantially one-dimensional materials that may be used, for example, in meshes, ribbon or substantially two-dimensional pieces of material (e.g., strips) may better resist stretching under tension, especially in a longitudinal direction. In some cases, using ribbons may also help increase comfort due to the increased surface contact area between the ribbons and a foot (or overlying layer of the foot, such as a sock, or other liner in the footwear).

As discussed above, some embodiments can use a backing layer for making the ribbon structure which can be removed (i.e., dissolved) when the final article is assembled. The ribbon structures disclosed above could be free-standing structures that provide substantial strength and support to a foot without the use of any other layers or liners between the foot and a ribbon structure.

The exemplary embodiments provide an upper including a ribbon structure. A ribbon structure may be comprised of a single continuous ribbon that is arranged into a pattern of overlapping ribbon portions or sections. Using a single continuous ribbon may help improve the efficiency of manufacturing by reducing the number of times a machine laying and attaching ribbon needs to stop or pause, and/or by reducing the need to include steps of cutting ribbons (either as the ribbon is laid down and/or prior to this). Moreover, by using a single continuous ribbon for the entire ribbon structure, the tendency of separate pieces of ribbon to separate at attachment points (e.g., stitching or welding points) may be reduced, resulting in increased strength and durability for the upper.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear, comprising:

a sole structure; and an upper positioned over the sole structure, the upper forming an inner peripheral edge an outer peripheral edge, wherein the inner peripheral edge extends around a throat opening of the upper and the outer peripheral edge engages the sole structure, wherein the upper comprises a ribbon structure including a ribbon portion provided by a long, flat and narrow strip of material that is elongated in a length direction relative to a width direction and elongated in the width direction relative to a thickness direction, the ribbon portion winding between the inner peripheral edge and the outer peripheral edge such that ribbon portion includes straight ribbon sections and curved ribbon sections.

2. The article of footwear according to claim 1, wherein:

the ribbon portion is a first ribbon portion wherein the curved ribbon sections of the first ribbon portion define course reversals such that the first ribbon portion winds repeatedly between the inner peripheral edge and the outer peripheral edge of the sole structure;

the ribbon structure comprises:

a backing layer, a first ribbon layer including the first ribbon portion, and a second ribbon layer including a second ribbon portion; and the second ribbon layer overlaps the first ribbon layer at selected locations to form nodes.

3. The article of footwear according to claim 2, wherein the ribbon structure comprises a first node in communication with a second node via a link, the link comprising a section of a ribbon portion extending between adjacent nodes.

4. The article of footwear according to claim 3, wherein a stitch penetrates the first ribbon portion and the second ribbon portion at the node.

5. The article of footwear according to claim 4, wherein the upper includes a border element extending along the outer peripheral edge, the border element comprising threads stitched together to form an interlocking matrix.

6. The article of footwear according to claim 5, wherein the border element comprises an embroidered structure.

7. The article of footwear according to claim 6, wherein the backing layer comprises mesh.

8. An article of footwear, comprising:

a sole structure; and an upper positioned over the sole structure, the upper comprising:

a ribbon structure including a first node in communication with a second node via a link, each node comprising overlapping first and second ribbon portions, wherein each of the first and second ribbon portions are formed of a long narrow strip of material having one flat surface on a first side and a second flat surface on an opposite side; and a border element covering a part of the first and second ribbon portions along a boundary of the upper adjacent to the sole structure.

9. The article of footwear according to claim 8, wherein a stitch penetrates the first ribbon portion and the second ribbon portion at the node.

10. The article of footwear according to claim 8, wherein the ribbon structure comprises a plurality of ribbon portions meeting one another at a plurality of nodes, and each ribbon portion possesses a width of approximately 2 mm to approximately 6 mm.

11. The article of footwear according to claim 8, wherein:

the upper defines an inner peripheral edge an outer peripheral edge;

the inner peripheral edge extends around a throat opening of the upper;

the outer peripheral edge is disposed adjacent the sole structure; and the border element extends along both the outer peripheral edge and the inner peripheral edge.

12. The article of footwear according to claim 11, wherein the first ribbon portion winds between the inner peripheral edge and the outer peripheral edge.

13. The article of footwear according to claim 9, wherein:

the ribbon structure comprises:

a backing layer, a first ribbon layer including the first ribbon portion, and a second ribbon layer including the second ribbon portion; and the second ribbon layer overlaps the first ribbon layer at selected locations to form the first and second nodes.

14. The article of footwear according to claim 13, wherein the first ribbon layer and the second ribbon layer form a lattice.

15. The article of footwear according to claim 13, wherein the first ribbon layer is secured to the backing layer via stitching.

16. The article of footwear according to claim 13, wherein the ribbon structure defines a plurality of links and a plurality of nodes, each link comprising a section of ribbon extending between two adjacent nodes.

17. The article of footwear according to claim 13, wherein the border is an embroidered structure.

18. The article of footwear according to claim 8, wherein the ribbon structure comprises a first continuous ribbon arranged into a first layer and a second continuous ribbon arranged into a second layer, the first layer and the second layer intersecting at the nodes.

19. The article of footwear according to claim 8, wherein:

the ribbon structure comprises:

a first ribbon layer; and a second ribbon layer, the second ribbon layer overlapping the first ribbon layer at selected locations to define the nodes; and the nodes are configured to move toward and away from each other.

20. An upper for an article of footwear, comprising:

an inner peripheral edge an outer peripheral edge, wherein the inner peripheral edge extends around a throat opening of the upper and the outer peripheral edge engages the sole structure; and a ribbon structure including a plurality of interconnected ribbon portions, each ribbon portion provided by a long, flat and narrow strip of material that is elongated in a length direction relative to a width direction and elongated in the width direction relative to a thickness direction, each ribbon portion winding repeatedly back and forth between the inner peripheral edge and the outer peripheral edge, wherein the ribbon structure includes a plurality of first nodes in communication with a plurality of second nodes via a link, each of the plurality of first nodes and the plurality of second nodes comprising overlapping first and second ribbon portions.

* * * * *